US010100994B2

(12) United States Patent
Yamamoto

(10) Patent No.: US 10,100,994 B2
(45) Date of Patent: Oct. 16, 2018

(54) VEHICLE LAMP

(71) Applicant: KOITO MANUFACTURING CO., LTD., Tokyo (JP)

(72) Inventor: Ippei Yamamoto, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 15/606,627

(22) Filed: May 26, 2017

(65) Prior Publication Data

US 2017/0261171 A1 Sep. 14, 2017

Related U.S. Application Data

(62) Division of application No. 14/892,273, filed as application No. PCT/JP2014/063902 on May 27, 2014.

(30) Foreign Application Priority Data

May 27, 2013 (JP) ..... 2013-110915
May 29, 2013 (JP) ..... 2013-113082

(51) Int. Cl.
*F21S 41/147* (2018.01)
*F21S 41/36* (2018.01)
(Continued)

(52) U.S. Cl.
CPC ..... *F21S 41/147* (2018.01); *F21S 41/333* (2018.01); *F21S 41/336* (2018.01); *F21S 41/338* (2018.01); *F21S 41/36* (2018.01); *F21Y 2115/10* (2016.08)

(58) Field of Classification Search
CPC ... B60Q 1/0041; F21S 48/1358–48/137; F21S 41/333; F21S 41/336; F21S 41/36; F21S 41/338
See application file for complete search history.

(56) References Cited

U.S. PATENT DOCUMENTS 2,071,652 A 2/1937 Northup
4,722,033 A 1/1988 VanDuyn et al.
(Continued)

FOREIGN PATENT DOCUMENTS

EP 2060442 A2 5/2009
EP 2103867 A2 9/2009
(Continued)

OTHER PUBLICATIONS

Extened European Search Report dated Jan. 30, 2017, by the European Patent Office in counterpart European Application No. 14804393.8.
(Continued)

*Primary Examiner* — Mariceli Santiago
(74) *Attorney, Agent, or Firm* — Sughrue Mion, PLLC

(57) ABSTRACT

In a vehicle lamp in which a plurality of lamp units is arranged side by side in a direction intersecting with a lamp longitudinal direction, a central luminous intensity of a light distribution pattern is increased while securing a sufficient irradiation light quantity. A first additional reflector 34A configured to reflect the light from a second light emitting element 22B toward the front is disposed in the vicinity of a front end edge 24A1 of a first reflector 24A.

8 Claims, 14 Drawing Sheets

(51) Int. Cl.
*F21S 41/33* (2018.01)
*F21Y 115/10* (2016.01)

(56) References Cited

U.S. PATENT DOCUMENTS

| | | | | |
|---|---|---|---|---|
| 5,556,190 | A * | 9/1996 | Saijo | B60Q 1/007 362/368 |
| 5,611,612 | A | 3/1997 | Choji et al. | |
| 5,692,824 | A | 12/1997 | Ooishi | |
| 6,076,945 | A | 6/2000 | Matsubara et al. | |
| 6,120,169 | A | 9/2000 | Sato | |
| 6,402,356 | B2 | 6/2002 | Gotou | |
| 6,505,962 | B2 | 1/2003 | Gotou | |
| 6,698,911 | B2 | 3/2004 | Naganawa et al. | |
| 7,066,631 | B2 * | 6/2006 | Davies | B60Q 1/0041 362/510 |
| 8,337,062 | B2 * | 12/2012 | Tanaka | B60Q 1/04 362/241 |
| 8,500,317 | B2 | 8/2013 | Janssen | |
| 2005/0088851 | A1 | 4/2005 | Davies et al. | |
| 2007/0153530 | A1 * | 7/2007 | Czajkowski | F21V 7/0008 362/341 |

FOREIGN PATENT DOCUMENTS

| | | | |
|---|---|---|---|
| EP | 2357397 | A2 | 8/2011 |
| JP | 11-86606 | A | 3/1999 |
| JP | 11-167803 | A | 6/1999 |
| JP | 2008-77890 | A | 4/2008 |
| JP | 4926770 | B2 | 5/2012 |

OTHER PUBLICATIONS

International Search Report dated Sep. 2, 2014 issued by International Searching Authority in counterpart International Patent Application No. PCT/JP2014/063902.

Written Opinion dated Sep. 2, 2014 issued by International Searching Authority in counterpart International Application No. PCT/JP2014/063902.

Office Action dated Jul. 14, 2017 by the U.S. Patent & Trademark Office in U.S. Appl. No. 14/892,273.

Communication dated Jan. 25, 2018, issued by the USPTO in counterpart U.S. Appl. No. 14/892,273.

Communication dated Jun. 11, 2018 issued by the United States Patent and Trademark Office in counterpart U.S. Appl. No. 14/892,273.

* cited by examiner

VEHICLE LAMP

CROSS-REFERENCE TO RELATED APPLICATIONS

This application is a divisional of U.S. application Ser. No. 14/892,273, filed Nov. 19, 2015, which is a National Stage of International Application No. PCT/JP2014/063902, filed May 27, 2014, which claims priority from Japanese Patent Application Nos. 2013-110915 filed May 27, 2013 and 2013-113082 filed May 29, 2013, the contents of all of which are incorporated herein by reference in their entirety.

TECHNICAL FIELD

The present invention relates to a vehicle lamp where a plurality of lamp units is arranged side by side in a direction intersecting with a lamp longitudinal direction.

BACKGROUND ART

Conventionally, there has been known a vehicle lamp where a plurality of lamp units each including a light emitting element and a reflector for reflecting the light from the light emitting element toward the front is arranged side by side in a direction intersecting with a lamp longitudinal direction.

As such a vehicle lamp, a vehicle lamp where a plurality of lamp units is arranged side by side in a vehicle width direction is disclosed in Patent Document 1.

CITATION LIST

Patent Document

Patent Document 1: Japanese Patent Publication No. 4926770

DISCLOSURE OF INVENTION

Problems to be Solved by Invention

In the conventional vehicle lamp, each of the plurality of lamp units has an optically independent configuration, and hence, the following problems are caused.

Specifically, in the case where a plurality of lamp units is arranged side by side in a direction intersecting with a lamp longitudinal direction, it is not easy to sufficiently secure a space occupied by each lamp unit. Therefore, it is not easy to sufficiently secure the light quantity of the reflected light from a reflector of each lamp unit. As a result, it is also not easy to sufficiently secure the irradiation light quantity of the entire lamp.

By contrast, in the case where a reflective surface of the reflector of each lamp unit is formed to have, as a reference surface, a paraboloid of revolution whose focal distance is short, it is possible to increase the utilization efficiency of the emitted light from the light emitting element. However, in this case, there is a problem that a central luminous intensity of a light distribution pattern, which is formed by the reflected light from the reflector, is lowered.

The present invention has been made in consideration of such circumstances and an object thereof is to provide a vehicle lamp in which a plurality of lamp units is arranged side by side in a direction intersecting with a lamp longitudinal direction and which is capable of increasing a central luminous intensity of a light distribution pattern while securing a sufficient irradiation light quantity.

Means for Solving the Problems

A vehicle lamp according to the present invention is a vehicle lamp comprising:

a first lamp unit comprising a first light emitting element and a first reflector configured to reflect the light from the first light emitting element toward the front, and a second lamp unit comprising a second light emitting element and a second reflector configured to reflect the light from the second light emitting element toward the front, wherein the first lamp unit and the second lamp unit are arranged side by side in a direction intersecting with a lamp longitudinal direction, and a first additional reflector configured to reflect the light from the second light emitting element toward the front is disposed in the vicinity of a front end edge of the first reflector.

The type of "the first light emitting element" and "the second light emitting element" is not particularly limited. For example, a light emitting diode or a laser diode or the like can be employed.

A specific direction of "the direction intersecting with the lamp longitudinal direction" is not particularly limited. For example, a vehicle width direction or a vertical direction or the like can be employed.

"The first lamp unit" and "the second lamp unit" may be configured to be arranged adjacent to each other, or may be configured to be spaced apart from each other.

A specific arrangement of "the first additional reflector" and a specific shape of the reflective surface thereof are not particularly limited, as long as the first additional reflector is arranged in the vicinity of the front end edge of the first reflector. Further, "the first additional reflector" may be formed integrally with the first reflector, or may be formed separately from the first reflector.

Further, a vehicle lamp according to the present invention is a vehicle lamp comprising:

a first lamp unit comprising a first light source and a first reflector configured to reflect the light from the first light source toward the front, and a second lamp unit comprising a second light source and a second reflector configured to reflect the light from the second light source toward the front, wherein the first lamp unit and the second lamp unit are arranged side by side in such a way that the second lamp unit is provided on the outside in a vehicle width direction, the second reflector is disposed so as to be positioned on the rear side of the first reflector, a reflective surface of the second reflector is formed so as to extend to the inside in the vehicle width direction up to a position of partially overlapping with a reflective surface of the first reflector, as seen from the front of the lamp, and a first overlapping portion of the reflective surface of the second reflector, which overlaps with the reflective surface of the first reflector, is formed so as to reflect the light from the second light source toward the outside in the vehicle width direction.

The type of "the first light source" and "the second light source" is not particularly limited. For example, a light emitting element such as a light emitting diode or a laser diode, or a light source bulb or the like can be employed.

A specific reflective surface shape of "the reflective surface of the first reflector" is not particularly limited.

A specific reflective surface shape of "the reflective surface of the second reflector" is not particularly limited, as long as the reflective surface of the second reflector is formed so as to extend to the inside in the vehicle width direction up to a position of partially overlapping with the reflective surface of the first reflector, as seen from the front of the lamp, and the first overlapping portion is configured to reflect the light from the second light source toward the outside in the vehicle width direction.

Effects of the Invention

According to the present invention, there is provided a vehicle lamp in which a plurality of lamp units is arranged side by side in a direction intersecting with a lamp longitudinal direction and which is capable of increasing a central luminous intensity of a light distribution pattern while securing a sufficient irradiation light quantity.

EMBODIMENT FOR CARRYING OUT INVENTION

Hereinafter, an embodiment of the present invention will be described with reference to the figures.

First Embodiment

Figure 1:
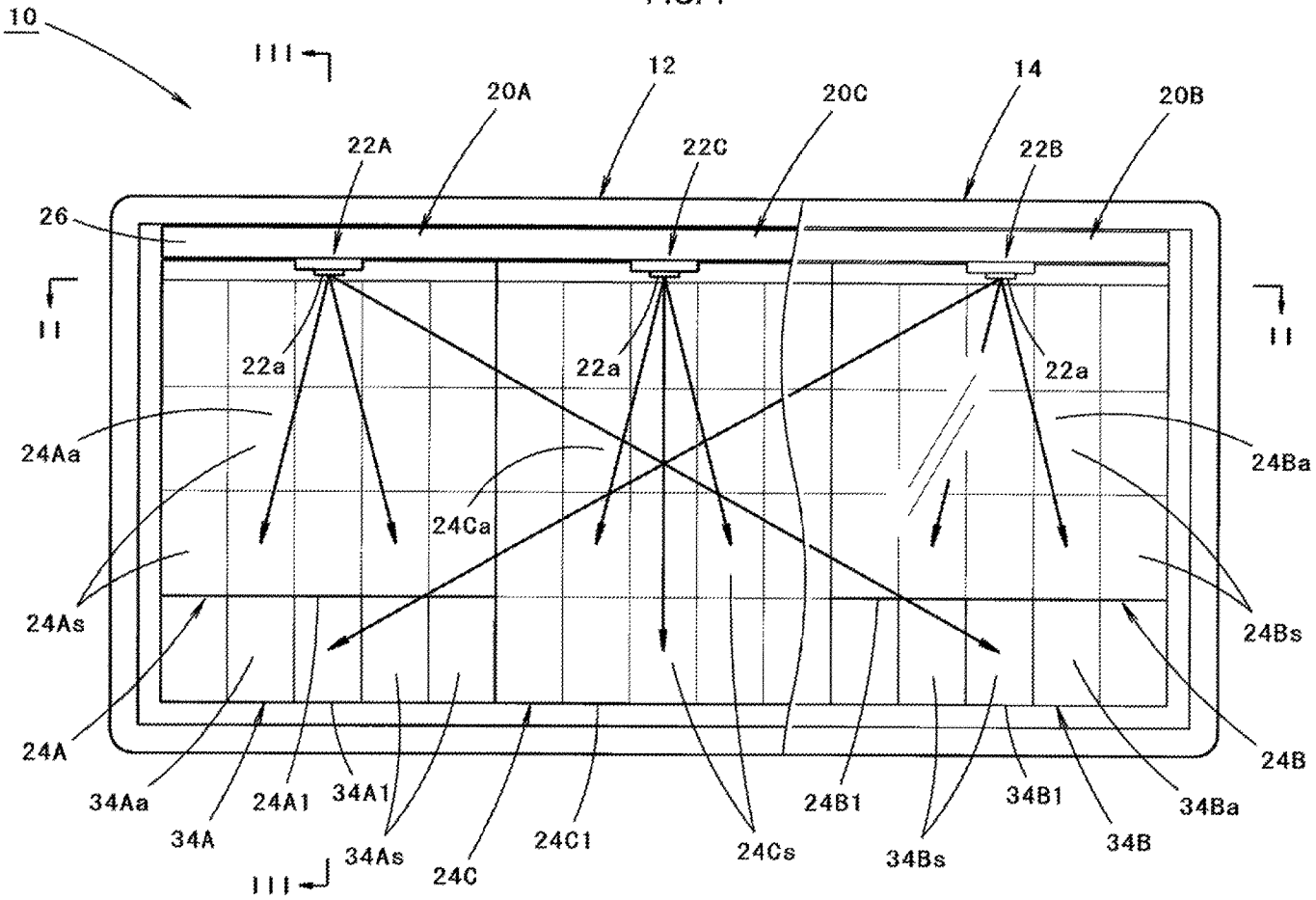
FIG. 1 is a front view showing a vehicle lamp according to a first embodiment of the present invention.

FIG. 1 is a front view showing a left vehicle lamp 10 according to a first embodiment of the present invention. Further, FIG. 2 is a sectional view taken along a line II-II in FIG. 1, and FIG. 3 is a sectional view taken along a line in FIG. 1.

As shown in these figures, the vehicle lamp 10 according to the present embodiment is a high-beam headlamp provided in a left front end portion of a vehicle. The vehicle lamp 10 has a configuration that three lamp units 20A, 20B, 20C are incorporated in a lamp chamber which is defined by a lamp body 12 and a transparent translucent cover 14 attached to a front end opening portion of the lamp body 12.

Figure 2:
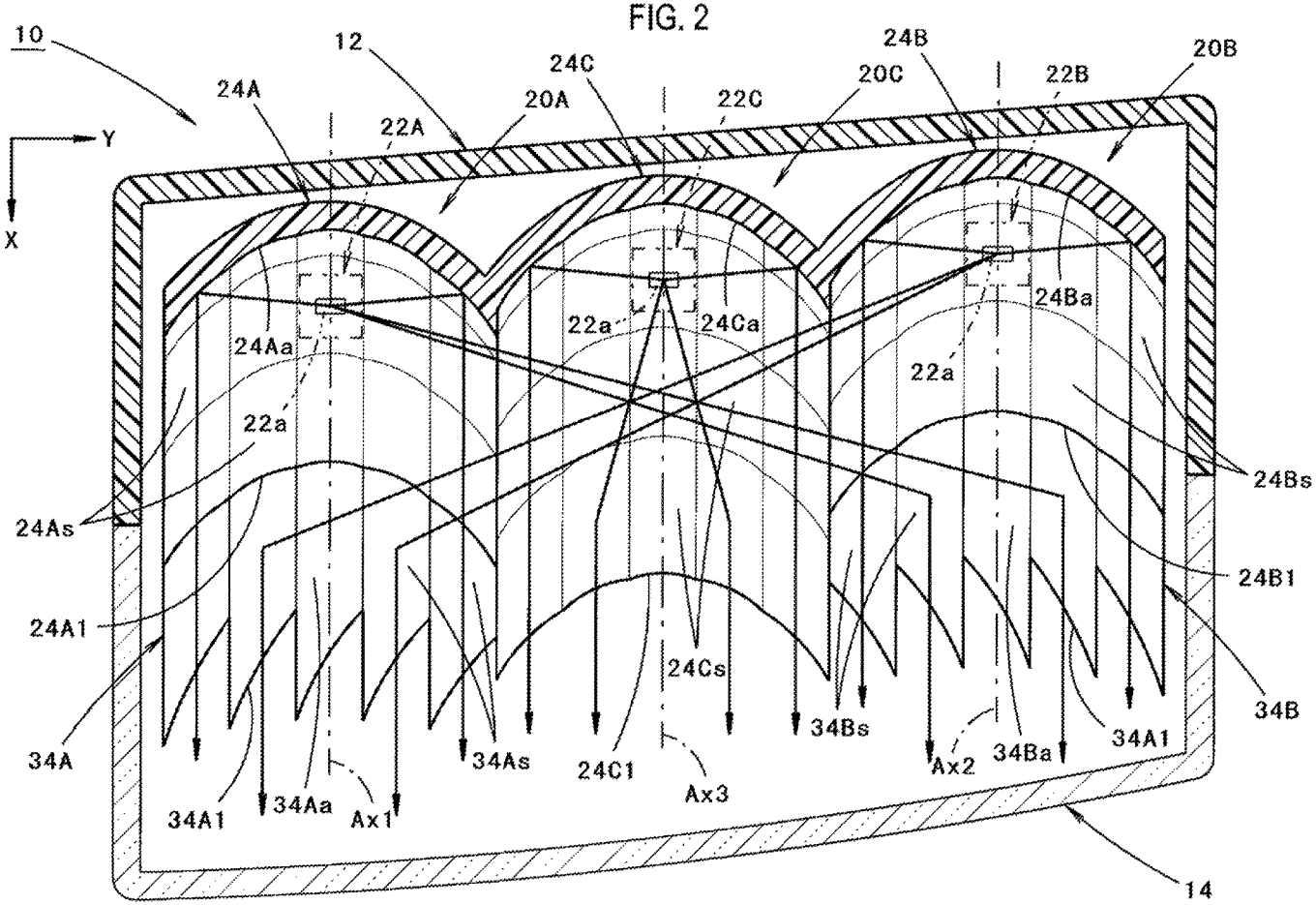
FIG. 2 is a sectional view taken along a line II-II in FIG. 1.
Figure 3:
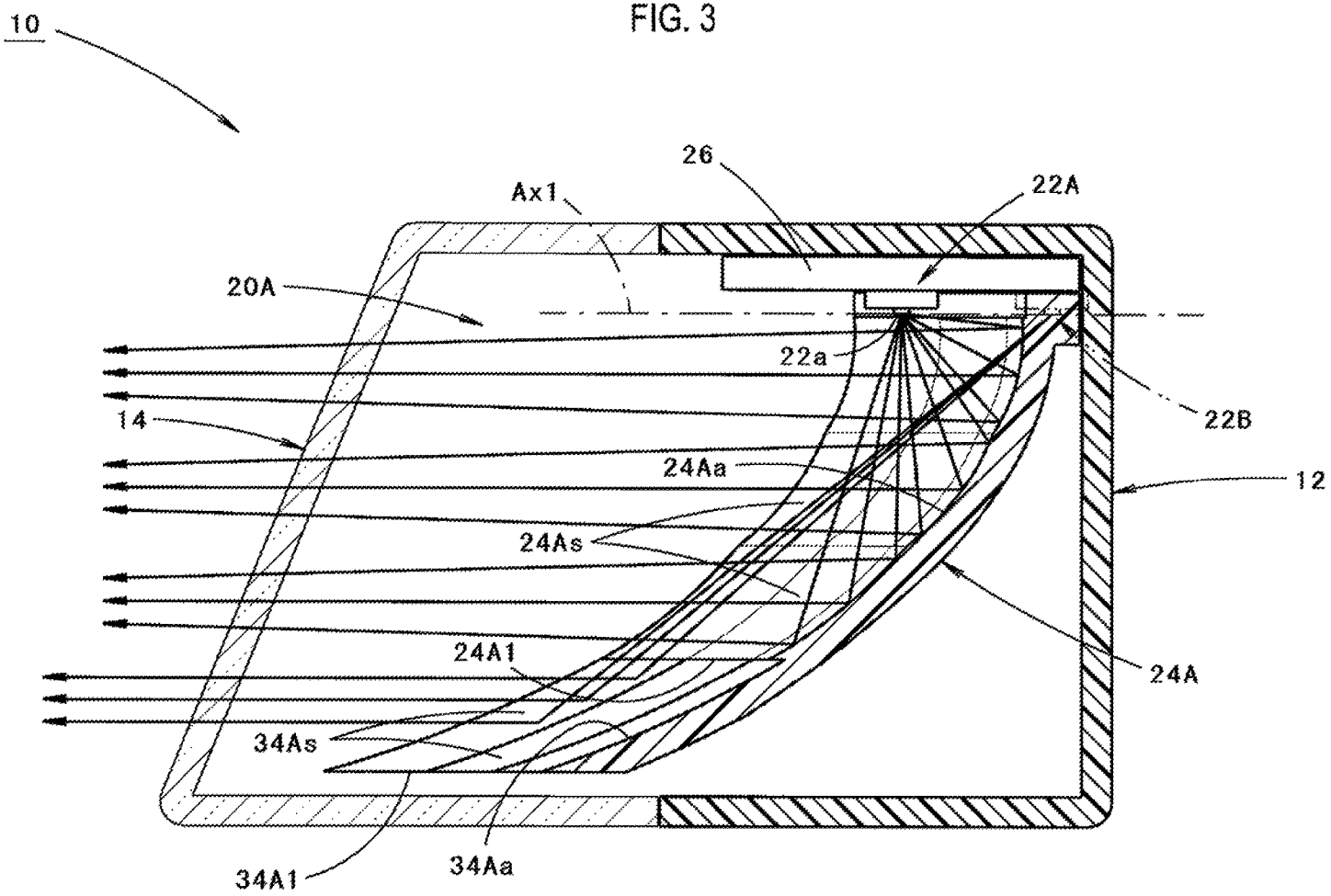
FIG. 3 is a sectional view taken along a line in FIG. 1.

In FIG. 2, a direction indicated by X refers to "the front" in the vehicle and the vehicle lamp 10, and a direction indicated by Y refers to "the left direction" orthogonal to "the front."

The translucent cover 14 is formed so as to be curved slightly rearward from a right end edge (a left end edge as seen from the front of the lamp) toward a left end edge thereof and formed so as to be inclined rearward from a lower end edge toward an upper end edge thereof.

Three lamp units 20A, 20B, 20C are arranged side by side in a vehicle width direction that is a direction intersecting with a lamp longitudinal direction. Further, the left one (i.e., one located on the outside in the vehicle width direction) is disposed in a state of being further displaced rearward.

All of these three lamp units 20A, 20B, 20C have a configuration to include light emitting elements 22A, 22B, 22C and reflectors 24A, 24B, 24C for reflecting the light from the light emitting elements 22A, 22B, 22C toward the front.

All of the light emitting elements 22A, 22B, 22C of these lamp units 20A, 20B, 20C have the same configuration. Specifically, each of these light emitting elements 22A, 22B, 22C is a light emitting diode to emit a white light and has a horizontally long rectangular light emitting surface 22*a*.

These three light emitting elements 22A, 22B, 22C are arranged at an equal interval in the vehicle width direction. The left one is in a state of being further displaced rearward. Further, each of these light emitting elements 22A, 22B, 22C is arranged in such a way that the rectangular light emitting surface 22*a* thereof faces downward. Each of the light emitting elements 22A, 22B, 22C is arranged in a posture in which a long side of the rectangular light emitting surface 22*a* extends in the vehicle width direction. Each of the light emitting elements 22A, 22B, 22C is arranged at the same height position.

These three light emitting elements 22A, 22B, 22C are supported on a common substrate 26, which is supported on the lamp body 12.

Further, the reflectors 24A, 24B, 24C of each of the lamp units 20A, 20B, 20C are arranged below each of the light emitting elements 22A, 22B, 22C.

In the following, the lamp unit 20A located at a right end portion (i.e., at the innermost in the vehicle width direction) is often described as "the first lamp unit 20A," the light source 22A thereof is often described as "the first light source 22A," and the reflector 24A thereof is often described as "the first reflector 24A." Further, the lamp unit 20B located at a left end portion is often described as "the second lamp unit 20B," the light source 22B thereof is often described as "the second light source 22B," and the reflector 24B thereof is often described as "the second reflector 24B." Furthermore, the lamp unit 20C located at the center is often described as "the third lamp unit 20C," the light source 22C thereof is often described as "the third light source 22C," and the reflector 24C thereof is often described as "the third reflector 24C."

Figure 4:
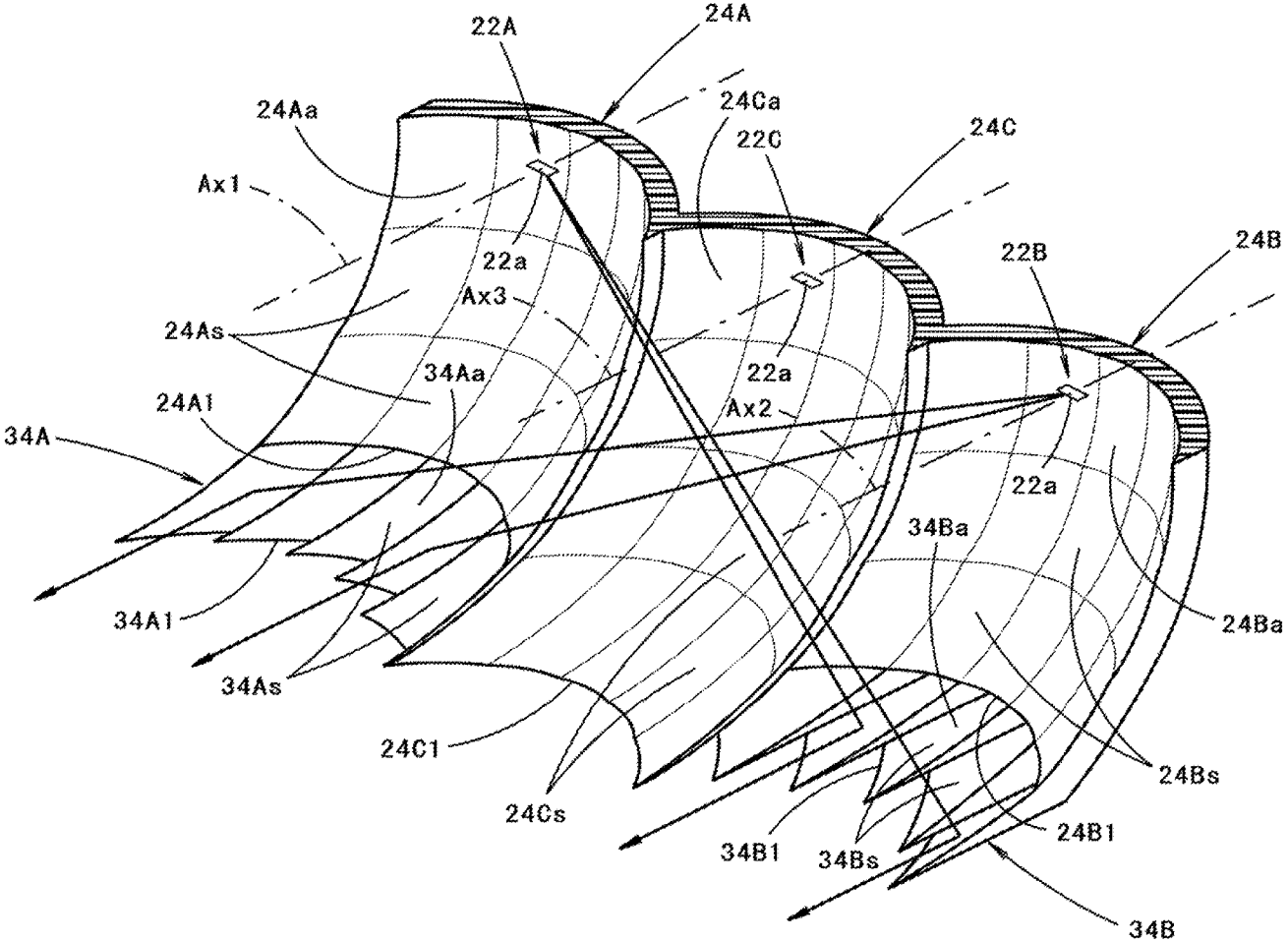
FIG. 4 is a perspective view showing a main portion of the vehicle lamp.

FIG. 4 is a perspective view of a main portion of the vehicle lamp 10.

As shown in FIG. 4, each of three reflectors 24A, 24B, 24C has a vertically long rectangular reflective surface shape, as seen from the front of the lamp, and the lateral widths thereof are set to the same value. However, the third reflector 24C located at the center is formed such that a front end edge 24C1 thereof is extended downward beyond front end edges 24A1, 24B1 of the first and second reflectors 24A, 24B which are located at both sides of the third reflector 24C.

Further, a first additional reflector 34A is disposed in the vicinity of the front end edge 24A1 of the first reflector 24A located at the right end portion, and a second additional reflector 34B is disposed in the vicinity of the front end edge 24B1 of the second reflector 24B located at the left end portion.

Each of the first and second additional reflectors 34A, 34B has a horizontally long rectangular reflective surface shape, as seen from the front of the lamp, and the lateral widths thereof are set to the same value as the lateral widths of the first and second reflectors 24A, 24B. Further, the first and second additional reflectors 34A, 34B are formed such that front end edges 34A1, 34B1 thereof are extended up to the same height position as a front end edge 24C1 of the third reflector 24C.

Three reflectors 24A, 24B, 24C are formed as a single member by an integral molding and supported on the substrate 26 (see FIG. 3). Further, two additional reflectors 34A, 34B are formed as a single member by an integral molding with these three reflectors 24A, 24B, 24C.

Subsequently, a specific configuration of each of the reflectors 24A, 24B, 24C and each of the additional reflectors 34A, 34B is described.

First, a configuration of the third reflector 24C located at the center is described.

A reflective surface 24Ca of the third reflector 24C is formed by a plurality of reflective elements 24Cs arranged in a grid pattern. Each of the reflective elements 24Cs is formed to have, as a reference surface, a paraboloid of revolution in which a light emitting center of the third light emitting element 22C is a focal point and an axis Ax3 extending in the longitudinal direction is a center axis.

Further, in the third reflector 24C, each reflective element 24Cs of the reflective surface 24Ca is adapted to diffusely reflect the light from the third light emitting element 22C in the vertical and lateral direction around a lamp front direction (i.e., X direction). At that time, each reflective element 24Cs is formed so as to reflect the light from the third light emitting element 22C in a relatively small diffusion angle in the vertical direction and in a relatively large diffusion angle in the lateral direction.

In the third reflector 24C, a plurality of reflective elements 24Cs constituting the reflective surface 24Ca is arranged in a grid pattern of four stages in the vertical direction and five rows in the lateral direction. The third reflector 24C extends downward beyond the other reflectors 24A, 24B by the vertical width of five reflective elements 24Cs of the plurality of reflective elements 24Cs, which are located at the lowest stage.

Subsequently, a configuration of the first reflector 24A located at the right end portion is described.

A reflective surface 24Aa of the first reflector 24A is also configured by a plurality of reflective elements 24As arranged in a grid pattern. At that time, the reflective surface 24Aa has the same reflective surface shape as the upper three-stage reflective areas of the plurality of reflective elements 24Cs in the reflective surface 24Ca of the third reflector 24C.

In this way, the first reflector 24A diffusely reflects the light from the light emitting element 22A in the vertical and lateral directions around the lamp front direction, thereby forming a light distribution pattern that is similar to the light distribution pattern formed by the reflected light from the upper three-stage reflective areas in the reflective surface 24Ca of the third reflector 24C.

Subsequently, a configuration of the second reflector 24B located at the left end portion is described.

A reflective surface 24Ba of the second reflector 24B is also configured by a plurality of reflective elements 24Bs arranged in a grid pattern and has the same reflective surface shape as the upper three-stage reflective areas in the reflective surface 24Ca of the third reflector 24C.

In this way, the second reflector 24B diffusely reflects the light from the light emitting element 22B in the vertical and lateral directions around the lamp front direction, thereby forming a light distribution pattern that is similar to the light distribution pattern formed by the reflected light from the upper three-stage reflective areas in the reflective surface 24Ca of the third reflector 24C.

Subsequently, a configuration of the first additional reflector 34A located at the right end portion is described.

In a reflective surface 34Aa of the first additional reflector 34A, a plurality of reflective elements 34As is arranged laterally in a row and in a vertical stripe shape. Each of these reflective elements 34As is formed in a paraboloid of revolution in which a light emitting center of the second light emitting element 22B is a focal point and an axis Ax2 extending in the longitudinal direction is a center axis. At that time, each of these reflective elements 34As is formed in the same lateral width as each reflective element 24As of the first reflector 24A, and a front end edge 34A1 thereof is formed in a sawtooth shape, as seen in a plan view.

Each reflective element 34As of the reflective surface 34Aa of the first additional reflector 34A reflects the light from the second light emitting element 22B in the lamp front direction.

Subsequently, a configuration of the second additional reflector 34B located at the left end portion is described.

In a reflective surface 34Ba of the second additional reflector 34B, a plurality of reflective elements 34Bs is arranged laterally in a row and in a vertical stripe shape. Each of these reflective elements 34Bs is formed in a paraboloid of revolution in which a light emitting center of the first light emitting element 22A is a focal point and an axis Ax1 extending in the longitudinal direction is a center axis. Each of these reflective elements 34As is formed in the same lateral width as each reflective element 24Bs of the second reflector 24B, and a front end edge 34B1 thereof is formed in a sawtooth shape, as seen in a plan view.

Each reflective element 34Bs of the reflective surface 34Ba of the second additional reflector 34B reflects the light from the first light emitting element 22A in the lamp front direction.

Figure 5:
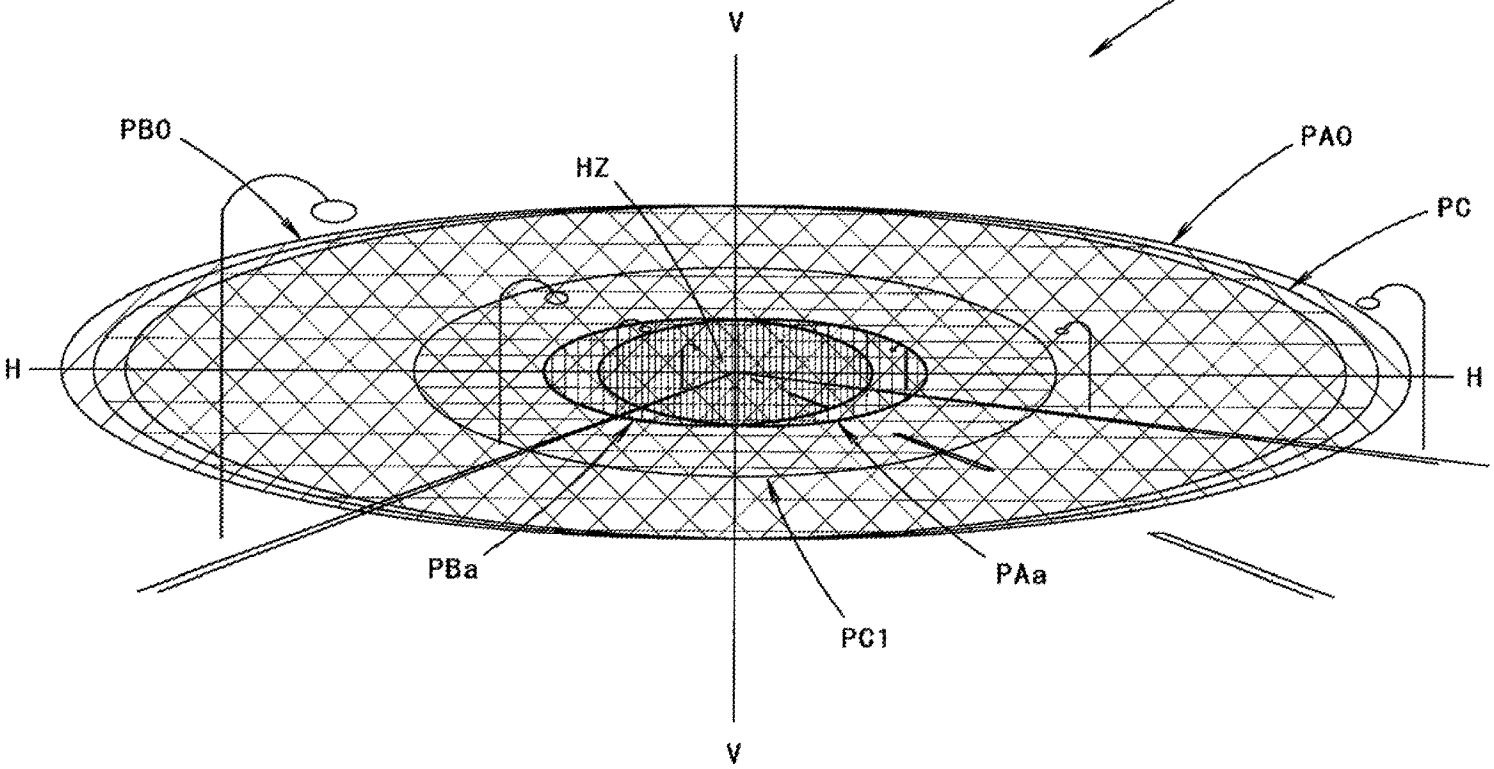
FIG. 5 is a view perspectively showing a high-beam light distribution pattern that is formed on a virtual vertical screen disposed at a position of 25 m in front of the vehicle lamp by the light irradiated forward from the vehicle lamp.

FIG. 5 is a view perspectively showing a high-beam light distribution pattern PH that is formed on a virtual vertical screen disposed at a position of 25 m in front of the vehicle lamp by the light irradiated forward from the vehicle lamp 10.

The high-beam light distribution pattern PH is formed as a light distribution pattern significantly spreading to both left and right sides about H-V that is a vanishing point in the lamp front direction. Therefore, a high luminous intensity area HZ is formed about the H-V.

The high-beam light distribution pattern PH is formed as a combined light distribution pattern of three basic light distribution patterns PA0, PB0, PC and two additional light distribution patterns PAa, PBa.

The basic light distribution patterns PA0 is a light distribution pattern formed by the light that is emitted from the first light emitting element 22A and reflected by the first reflector 24A. The basic light distribution pattern PB0 is a light distribution pattern formed by the light that is emitted from the second light emitting element 22B and reflected by the second reflector 24B. The basic light distribution pattern PC is a light distribution pattern formed by the light that is emitted from the third light emitting element 22C and reflected by the third reflector 24C.

Each of these three basic light distribution patterns PA0, PB0, PC is formed as a light distribution pattern significantly spreading to both left and right sides about the H-V that is a vanishing point in the lamp front direction. These basic light distribution patterns PA0, PB0, PC are formed in a state of being substantially overlapped with each other.

The basic light distribution pattern PC is brighter than the basic light distribution patterns PA0, PB0. The reason is that the light quantity of the reflected light from the third reflector 24C is greater than that of the reflected light from the first and second reflectors 24A, 24B by the amount corresponding to the reflected light from the lowest-stage reflective area of the reflective surface 24Ca. Since the lowest-stage reflective area of the reflective surface 24Ca is slightly spaced apart from the light emitting element 22C, a light distribution pattern PC1 formed by the reflected light from the lowest-stage reflective area is formed as a relatively small light distribution pattern in the central portion of the basic light distribution pattern PC.

The additional light distribution pattern PAa is a light distribution pattern formed by the light that is emitted from the second light emitting element 22B and reflected by the first additional reflector 34A. The additional light distribution pattern PBa is a light distribution pattern formed by the light that is emitted from the first light emitting element 22A and reflected by the second additional reflector 34B.

At that time, the reflective surface 34Aa of the first additional reflector 34A is significantly spaced apart from the second light emitting element 22B and each reflective element 34As thereof is configured to reflect the light from the second light emitting element 22B in the lamp front direction. Accordingly, the additional light distribution pattern PAa is formed as a small and bright light distribution pattern in the vicinity of the H-V.

Similarly, the reflective surface 34Ba of the second additional reflector 34B is significantly spaced apart from the first light emitting element 22A and each reflective element 34Bs thereof is configured to reflect the light from the first light emitting element 22A in the lamp front direction. Accordingly, the additional light distribution pattern PBa is formed as a small and bright light distribution pattern in the vicinity of the H-V.

Further, these two additional light distribution patterns PAa, PBa are formed to be substantially overlapped with each other in the vicinity of the H-V, so that the high luminous intensity area HZ of the high-beam light distribution pattern PH becomes extremely bright.

Subsequently, function effects of the present embodiment are described.

In each vehicle lamp 10 according to the present embodiment, the first lamp unit 20A including the first light emitting element 22A and the first reflector 24A, and the second lamp unit 20B including the second light emitting element 22B and the second reflector 24B are arranged side by side in a direction (a vehicle width direction in the present embodiment) intersecting with the lamp longitudinal direction. Further, the first additional reflector 34A for reflecting the light from the second light emitting element 22B toward the front is disposed in the vicinity of the front end edge 24A1 of the first reflector 24A. As a result, the following function effects can be obtained.

Specifically, as the irradiation light from the entire lamp, the light emitted from the second light emitting element 22B and reflected by the first additional reflector 34A is obtained, in addition to the light emitted from the first light emitting element 22A and reflected by the first reflector 24A and the light emitted from the second light emitting element 22B and reflected by the second reflector 24B. As a result, it is possible to increase the irradiation light quantity, correspondingly.

At that time, a distance from the second light emitting element 22B to the reflective surface 34Aa of the first additional reflector 34A is significantly longer than a distance from the first light emitting element 22A to the reflective surface 24Aa of the first reflector 24A or a distance from the second light emitting element 22B to the reflective surface 24Ba of the second reflector 24B. Therefore, the central luminous intensity of the additional light distribution pattern PAa formed by the reflected light from the first additional reflector 34A can be significantly greater than the central luminous intensity of the basic light distribution pattern PA0 formed by the reflected light from the first reflector 24A or the basic light distribution pattern PB0 formed by the reflected light from the second reflector 24B. As a result, it is also possible to increase the central luminous intensity of the high-beam light distribution pattern PH formed by the irradiation light from the entire lamp.

Thus, according to the present embodiment, in the vehicle lamp 10 where a plurality of lamp units 20A, 20B is arranged side by side in the vehicle width direction, it is possible to increase the central luminous intensity of the high-beam light distribution pattern PH while securing a sufficient irradiation light quantity.

In the vehicle lamp 10 according to the present embodiment, each of the first and second lamp units 20A, 20B uses the light emitting elements 22A, 22B as a light source.

Since such light emitting elements 22A, 22B have high luminous intensity in a specific direction, as in the present embodiment, it is possible to easily align the orientation of each of the light emitting elements 22A, 22B and it is also possible to easily arrange the first and second reflectors 24A, 24B in a state where the orientation of the reflective surfaces 24Aa, 24Ba is aligned. By doing so, the light from the second light emitting element 22B can easily reach the first additional reflector 34A.

Further, in the present embodiment, the second additional reflector 34B for reflecting the light from the first light emitting element 22A toward the front is disposed in the vicinity of the front end edge 24B1 of the second reflector 24B. As a result, the following function effects can be obtained.

Specifically, since the light emitted from the first light emitting element 22A and reflected by the second additional reflector 34B is applied as the irradiation light, it is possible to further increase the irradiation light quantity of the entire lamp, correspondingly. Further, the central luminous intensity of the additional light distribution pattern PBa formed by the reflected light can be significantly greater than the central luminous intensity of the basic light distribution pattern PA0 formed by the reflected light from the first reflector 24A or the basic light distribution pattern PB0 formed by the reflected light from the second reflector 24B. As a result, it is also possible to further increase the central luminous intensity of the high-beam light distribution pattern PH formed by the irradiation light from the entire lamp.

By the way, a distance from the second light emitting element 22B to the reflective surface 34Aa of the first additional reflector 34A is longer than a distance from the second light emitting element 22B to the reflective surface 34Ba of the second additional reflector 34B. Further, a distance from the first light emitting element 22A to the reflective surface 34Ba of the second additional reflector 34B is longer than a distance from the first light emitting element 22A to the reflective surface 34Aa of the first additional reflector 34A.

Therefore, the central luminous intensity of the additional light distribution pattern PAa formed by the light emitted from the second light emitting element 22B and reflected by the first additional reflector 34A can be greater than the central luminous intensity of a light distribution pattern when the light distribution pattern is formed by reflecting the light from the second light emitting element 22B by the second additional reflector 34B.

Similarly, the central luminous intensity of the additional light distribution pattern PBa formed by the light emitted from the first light emitting element 22A and reflected by the second additional reflector 34B can be greater than the central luminous intensity of a light distribution pattern when the light distribution pattern is formed by reflecting the light from the first light emitting element 22A by the first additional reflector 34A.

Furthermore, in the present embodiment, the first and second light emitting elements 22A, 22B have the light emitting surface 22*a* extending in an arrangement direction (vehicle width direction) of the lamp units 20A, 20B, 20C. As a result, the following function effects can be obtained.

Specifically, in the shape of the light emitting surface of the second light emitting element 22B as seen from the reflective surface 34Aa of the first additional reflector 34A, a long side of the rectangular light emitting surface looks short. Therefore, this shape is close to a square shape, as compared to the shape of the light emitting surface of the second light emitting element 22B as seen from the reflective surface 34Ba of the second additional reflector 34B. Further, in the shape of the light emitting surface of the first light emitting element 22A as seen from the reflective surface 34Ba of the second additional reflector 34B, a long side of the rectangular light emitting surface looks short. Therefore, this shape is close to a square shape, as compared to the shape of the light emitting surface of the first light emitting element 22A as seen from the reflective surface 34Aa of the first additional reflector 34A.

Therefore, from the viewpoint of the shape of the light emitting surface, it is possible to achieve the function effect that the central luminous intensity of the additional light distribution pattern PAa formed by the light emitted from the second light emitting element 22B and reflected by the first additional reflector 34A can be greater than the central luminous intensity of a light distribution pattern when the light distribution pattern is formed by reflecting the light from the second light emitting element 22B by the second additional reflector 34B.

Similarly, from the viewpoint of the shape of the light emitting surface, it is possible to achieve the function effect that the central luminous intensity of the additional light distribution pattern PBa formed by the light emitted from the first light emitting element 22A and reflected by the second additional reflector 34B can be greater than the central luminous intensity of a light distribution pattern when the light distribution pattern is formed by reflecting the light from the first light emitting element 22A by the first additional reflector 34A.

Further, in the present embodiment, the third lamp unit 20C is disposed between the first lamp unit 20A and the second lamp unit 20B. As a result, the following function effects can be obtained.

Specifically, by employing such a configuration, a distance from the second light emitting element 22B to the reflective surface 34Aa of the first additional reflector 34A is further increased. Therefore, the central luminous intensity of the additional light distribution pattern PAa formed by the light emitted from the second light emitting element 22B and reflected by the first additional reflector 34A is further increased. Further, a distance from the first light emitting element 22A to the reflective surface 34Ba of the second additional reflector 34B is further increased. Therefore, the central luminous intensity of the additional light distribution pattern PBa formed by the light emitted from the first light emitting element 22A and reflected by the second additional reflector 34B is further increased.

At that time, in the present embodiment, the third lamp unit 20C employs a configuration including the third light emitting element 22C and the third reflector 24C for reflecting the light from the third light emitting element 22C toward the front. Further, the third lamp unit 20C is arranged in a state where the orientation of the reflective surface 24Ca of the third reflector 24C is aligned with the orientation of the reflective surfaces 24Aa, 24Ba of the first and second reflectors 24A, 24B. As a result, the following function effects can be obtained.

Specifically, by employing such a configuration, light incidence from the second light emitting element 22B to the reflective surface 34Aa of the first additional reflector 34A and light incident from the first light emitting element 22A to the reflective surface 34Ba of the second additional reflector 34B can be carried out without difficulty.

In the above embodiment, an example has been described in which the reflective surfaces 24Aa, 24Ba, 24Ca of respective reflectors 24A, 24B, 24C are configured by a plurality of reflective elements 24As, 24Bs, 24Cs. However, a reflective surface made of a single curved surface may be employed.

In the above embodiment, an example has been described in which the reflective surfaces 34Aa, 34Ba of respective additional reflectors 34A, 34B are configured by a plurality of reflective elements 34As, 34Bs. However, a reflective surface made of a single curved surface may be employed.

In the above embodiment, an example has been described in which a lower end edge of the first reflector 24A is configured as the front end edge 24A1, and the first additional reflector 34A is disposed in the vicinity of the lower end edge. However, a right end edge of the first reflector 24A may be configured as the front end edge, and the first additional reflector may be disposed in the vicinity of the right end edge. Similarly, a left end edge of the second reflector 24B may be configured as the front end edge, and the second additional reflector may be disposed in the vicinity of the left end edge.

In the above embodiment, each of the lamp units 20A, 20B, 20C has a configuration that the reflectors 24A, 24B, 24C are disposed below the light emitting elements 22A, 22B, 22C arranged in a state where the light emitting surfaces 22*a* face downward. However, each of the lamp units may have a configuration that the reflectors 24A, 24B, 24C are disposed above the light emitting elements 22A, 22B, 22C arranged in a state where the light emitting surfaces 22*a* face upward.

In the above embodiment, an example has been described in which the vehicle lamp 10 is a high-beam headlamp provided in the left front end portion of a vehicle. However, the vehicle lamp may be configured as a high-beam headlamp provided in the right front end portion of the vehicle. Further, the vehicle lamp may be configured as a headlamp for forming a low-beam light distribution pattern. Furthermore, the vehicle lamp may be configured as a fog lamp or a daytime running lamp, or may be configured as a marker lamp such as a tail lamp, for example.

Modified Example of First Embodiment

Subsequently, a modified example of the first embodiment is described.

Figure 6:
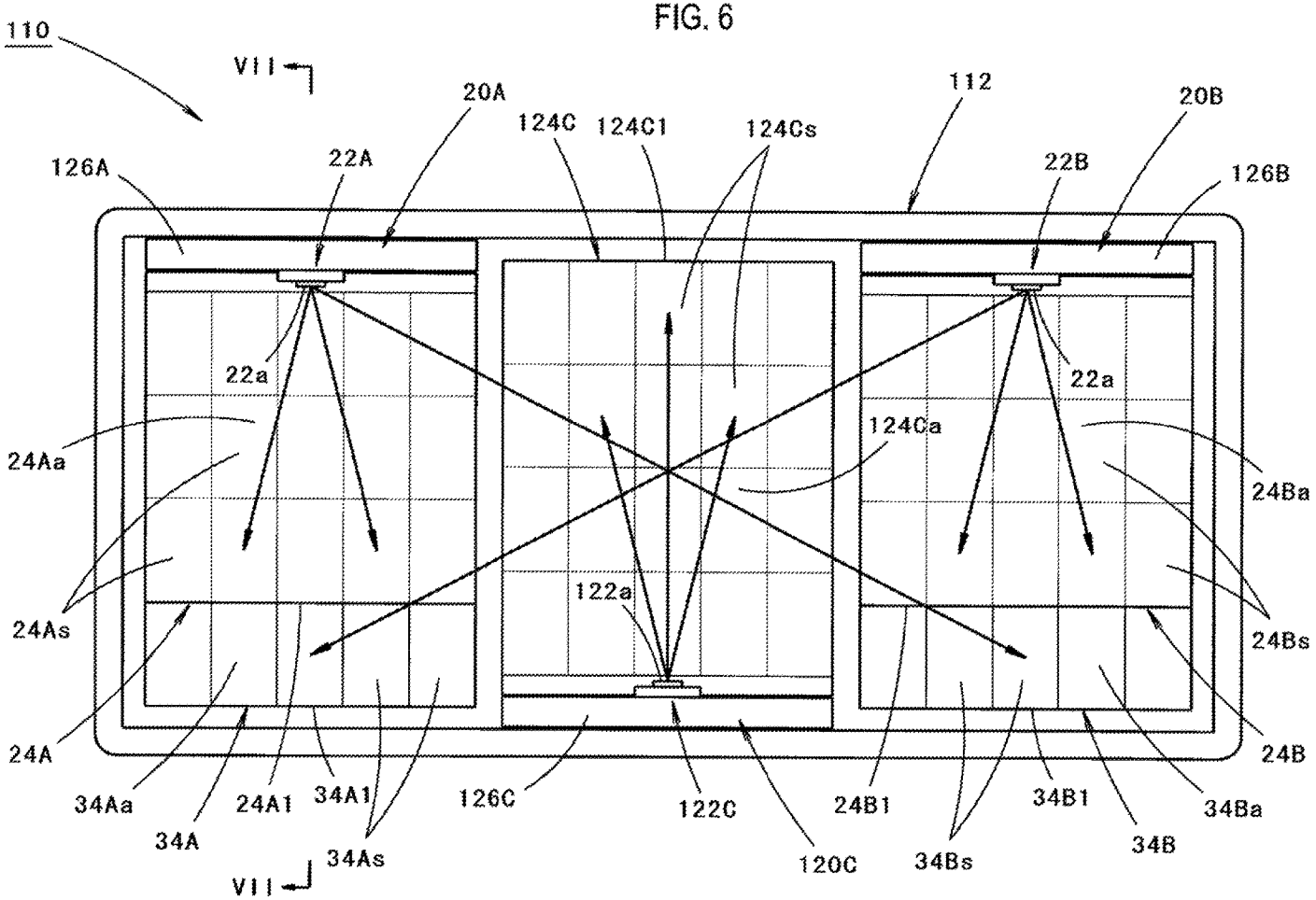
FIG. 6 is a view substantially similar to FIG. 1, showing a vehicle lamp according to a modified example of the first embodiment.
Figure 7:
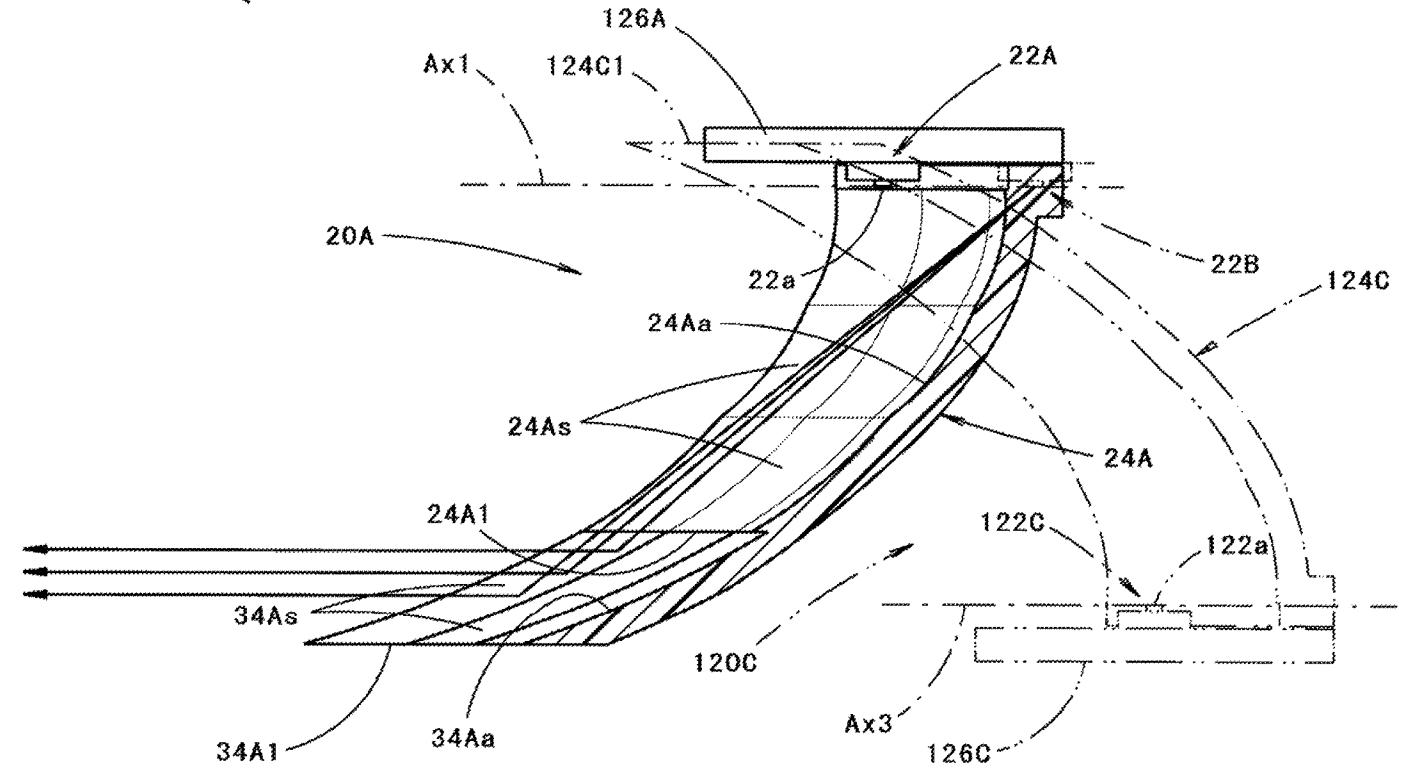
FIG. 7 is a view substantially similar to FIG. 3, showing the vehicle lamp according to the modified example.

FIGS. 6 and 7 are views similar to FIGS. 1 and 3, showing a vehicle lamp 110 according to the present modified example.

As shown in these figures, a basic configuration of this vehicle lamp 110 is similar to the vehicle lamp 10 of the above embodiment. However, a configuration of a third lamp unit 120C is different from the case of the above embodiment.

Specifically, also in the present modified example, three lamp units 20A, 20B, 120C are arranged side by side in the vehicle width direction. However, the third lamp unit 120C located at the center is arranged in an upside down state with respect to the third lamp unit 20C of the above-described first embodiment.

A third light emitting element 122C of the third lamp unit 120C is arranged so as to extend in the vehicle width direction in such a way that a light emitting surface 122*a* thereof faces upward. In this state, the third light emitting element 122C is supported on a substrate 126C, which is supported on the lamp body 112. At that time, the substrate 126C is arranged at substantially the same height position as the front end edges 34A1, 34B1 of the first and second additional reflectors 34A, 34B.

In the present modified example, the first light emitting element 22A of the first lamp unit 20A is supported on a substrate 126A, and the second light emitting element 22B of the second lamp unit 20B is supported on a substrate 126B. Further, each of these substrates 126A, 126B is supported on the lamp body 112.

As shown in FIG. 7, the third lamp unit 120C is arranged in such a way that the third light emitting element 122C is positioned at the rear side of the first and second light emitting elements 22A, 22B of the first and second lamp units 20A.

A third reflector 124C of the third lamp unit 120C is arranged above the third light emitting element 122C, and a front end edge 124C1 thereof is arranged at substantially the same height position as the substrates 126A, 126B.

A reflective surface 124Ca of the third reflector 124C is configured by a plurality of reflective elements 124Cs arranged in a grid pattern. Each of these reflective elements 124Cs is formed to have, as a reference surface, a paraboloid of revolution in which a light emitting center of the third light emitting element 122C is a focal point and the axis Ax3 extending in the longitudinal direction is a center axis.

The third reflector 124C is adapted to form a low-beam light distribution pattern by causing the light from the third light emitting element 22C to be diffusely reflected and appropriately deflection-reflected toward the front by each reflective element 124Cs of the reflective surface 124Ca.

Also in the case of employing the configuration of the present modified example, the emitted light from the second light emitting element 22B can be incident on the reflective surface 34Aa of the first additional reflector 34A and reflected to the lamp front direction. Further, the emitted light from the first light emitting element 22A can be incident on the reflective surface 34Ba of the second additional reflector 34B and reflected to the lamp front direction. By doing so, it is possible to increase the central luminous intensity of the high-beam light distribution pattern PH while securing a sufficient irradiation light quantity.

In the present modified example, the third light emitting element 122C of the third lamp unit 120C is located, to some extent, at the rear side of the first and second light emitting elements 22A, 22B of the first and second lamp units 20A. Therefore, light incidence from the second light emitting element 22B to the reflective surface 34Aa of the first additional reflector 34A and light incident from the first light emitting element 22A to the reflective surface 34Ba of the second additional reflector 34B can be carried out without being shielded by the third reflector 124C of the third lamp unit 120C.

Second Embodiment

By the way, in the vehicle lamp disclosed in the Patent Document 1, the reflective surfaces of the reflectors of respective lamp units are arranged in a state of being spaced apart from each other in the vehicle width direction, as seen from the front of the lamp. Accordingly, it is not easy to sufficiently secure the size of the reflective surface of each reflector in a limited space of the vehicle lamp. As a result, there is also a problem that it is not easy to sufficiently secure the irradiation light quantity of the entire lamp.

The second embodiment of the present invention, which will be described below, can secure a sufficient irradiation light quantity in a limited space of a vehicle lamp where a plurality of lamp units is arranged side by side in the vehicle width direction.

Figure 8:
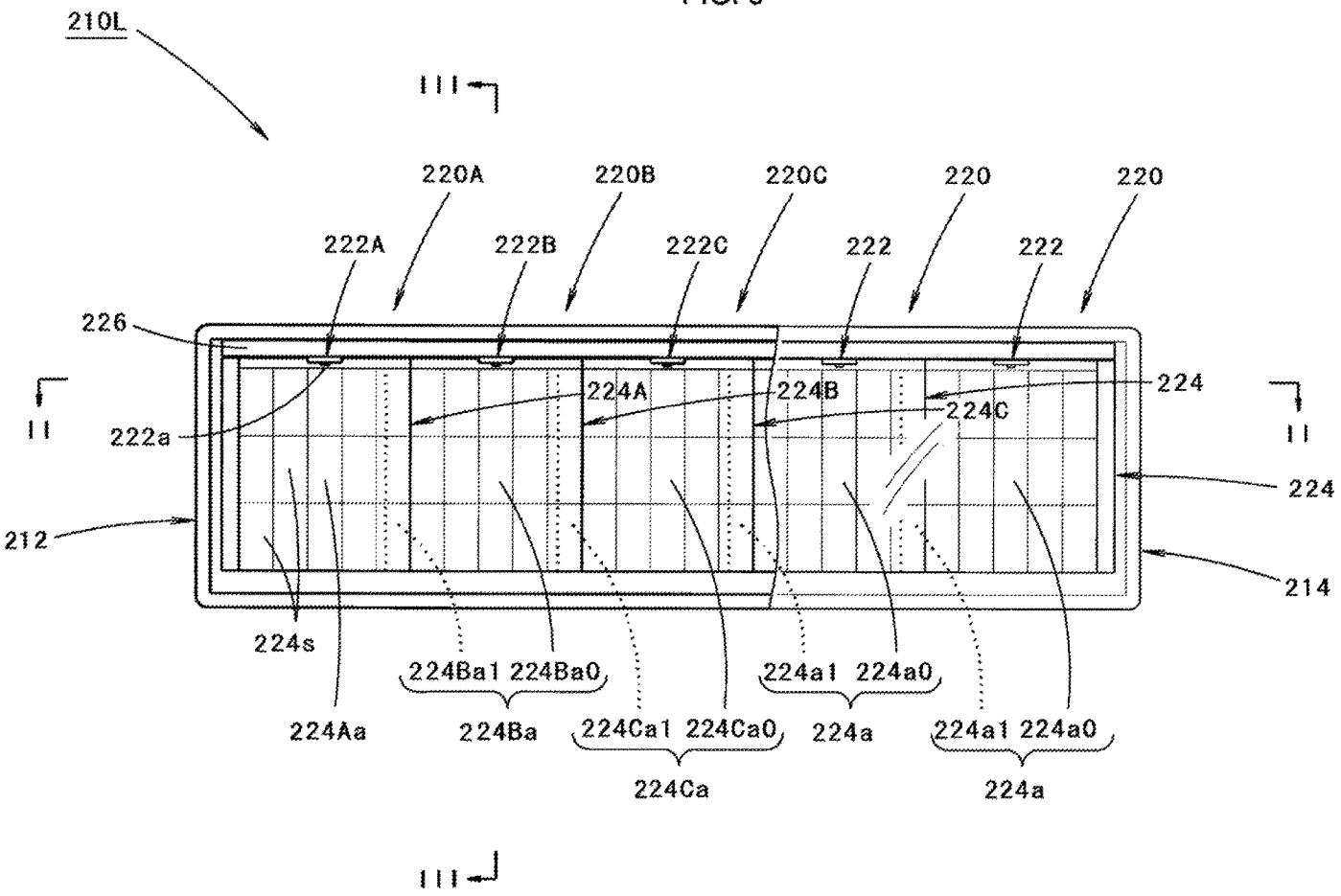
FIG. 8 is a front view showing a left vehicle lamp according to a second embodiment of the present invention.

FIG. 8 is a front view showing a left vehicle lamp 210L according to the second embodiment of the present invention. Further, FIG. 9 is a sectional view taken along a line II-II in FIG. 8, and FIG. 10 is a sectional view taken along a line in FIG. 8.

As shown in these figures, the vehicle lamp 210L according to the present embodiment is a high-beam headlamp provided in a left front end portion of a vehicle. The vehicle lamp 210L has a configuration that five lamp units 220 are incorporated in a lamp chamber which is defined by a lamp body 212 and a transparent translucent cover 214 attached to a front end opening portion of the lamp body 212.

Figure 9:
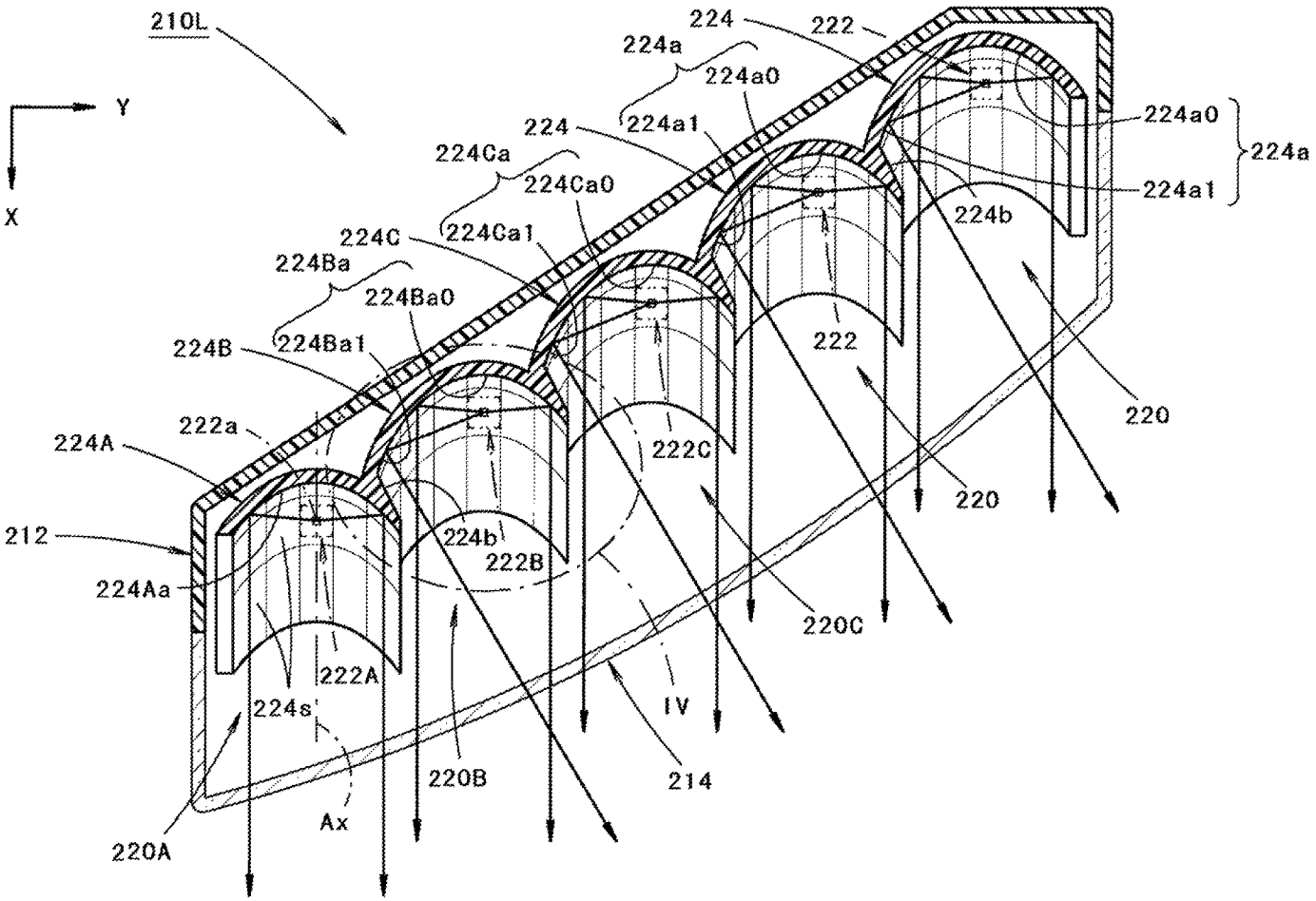
FIG. 9 is a sectional view taken along a line II-II in FIG. 8.
Figure 10:
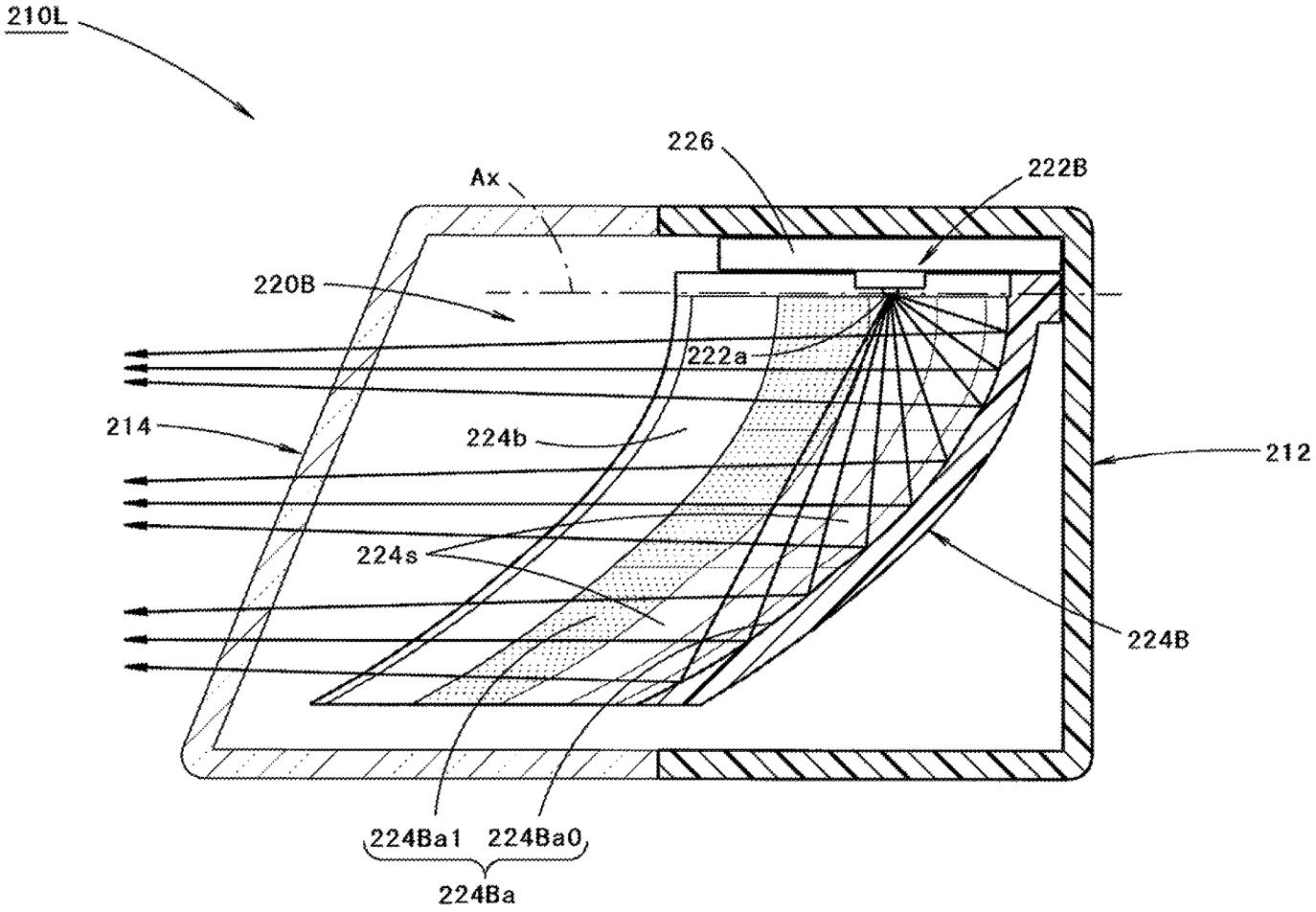
FIG. 10 is a sectional view taken along a line in FIG. 8.

In FIG. 9, a direction indicated by X refers to "the front" in the vehicle and the vehicle lamp 210, and a direction indicated by Y refers to "the left direction" orthogonal to "the front."

The translucent cover 214 is formed so as to be curved rearward from a right end edge (a left end edge as seen from the front of the lamp) toward a left end edge thereof and formed so as to be inclined rearward from a lower end edge toward an upper end edge thereof.

Five lamp units 220 are arranged side by side in the vehicle width direction. Further, the lamp unit 220 located at the left (i.e., at the outside in the vehicle width direction) is disposed in a state of being further displaced rearward.

Each of these five lamp units 220 has a configuration to include a light source 222 and a reflector 224 for reflecting the light from the light source 222 toward the front.

In the following, the lamp unit 220 located at the innermost in the vehicle width direction is often described as "the first lamp unit 220A," the light source 222 thereof is often described as "the first light source 222A," and the reflector 224 thereof is often described as "the first reflector 224A." Further, the lamp unit 220 close to the outside in the vehicle width direction of the first lamp unit 220A is often described as "the second lamp unit 220B," the light source 222 thereof is often described as "the second light source 222B," and the reflector 224 thereof is often described as "the second reflector 224B." Furthermore, the lamp unit 220 close to the outside in the vehicle width direction of the second lamp unit 220B is often described as "the third lamp unit 220C," the light source 222 thereof is often described as "the third light source 222C," and the reflector 224 thereof is often described as "the third reflector 224C."

All of these five lamp units 220 have the same configuration except that a configuration of the first reflector 224A of the first lamp unit 220A is partially different from the others.

Specifically, the light sources 222 of each of these lamp units 220 are light emitting elements (specifically, light emitting diodes to emit a white light) and are arranged at an equal interval in the vehicle width direction. At that time, the left one in these five light sources 222 is further displaced rearward, and the rearward displacement amounts of these five light sources 222 are set to the same value. Further, each of these light sources 222 is arranged in the same height position in a state where the light emitting surface 222*a* thereof faces downward. Further, these five light sources 222 are supported on a common substrate 226, which is supported on the lamp body 212.

Further, the reflector 224 of each lamp unit 220 is arranged below each light source 222. These five reflectors 224 are formed as a single member by an integral molding and supported on the substrate 226.

Each of these five reflectors 224 has a rectangular reflective surface shape, as seen from the front of the lamp.

At that time, the reflective surfaces 224*a* of the reflectors 224 other than the first reflector 224A (i.e., the reflector 224 located at the innermost in the vehicle width direction) are formed so as to extend to the inside in the vehicle width direction up to a position of partially overlapping with the reflective surface 224*a* of the reflector 224, which is close to the inside in the vehicle width direction of each reflector 224.

Figure 11:
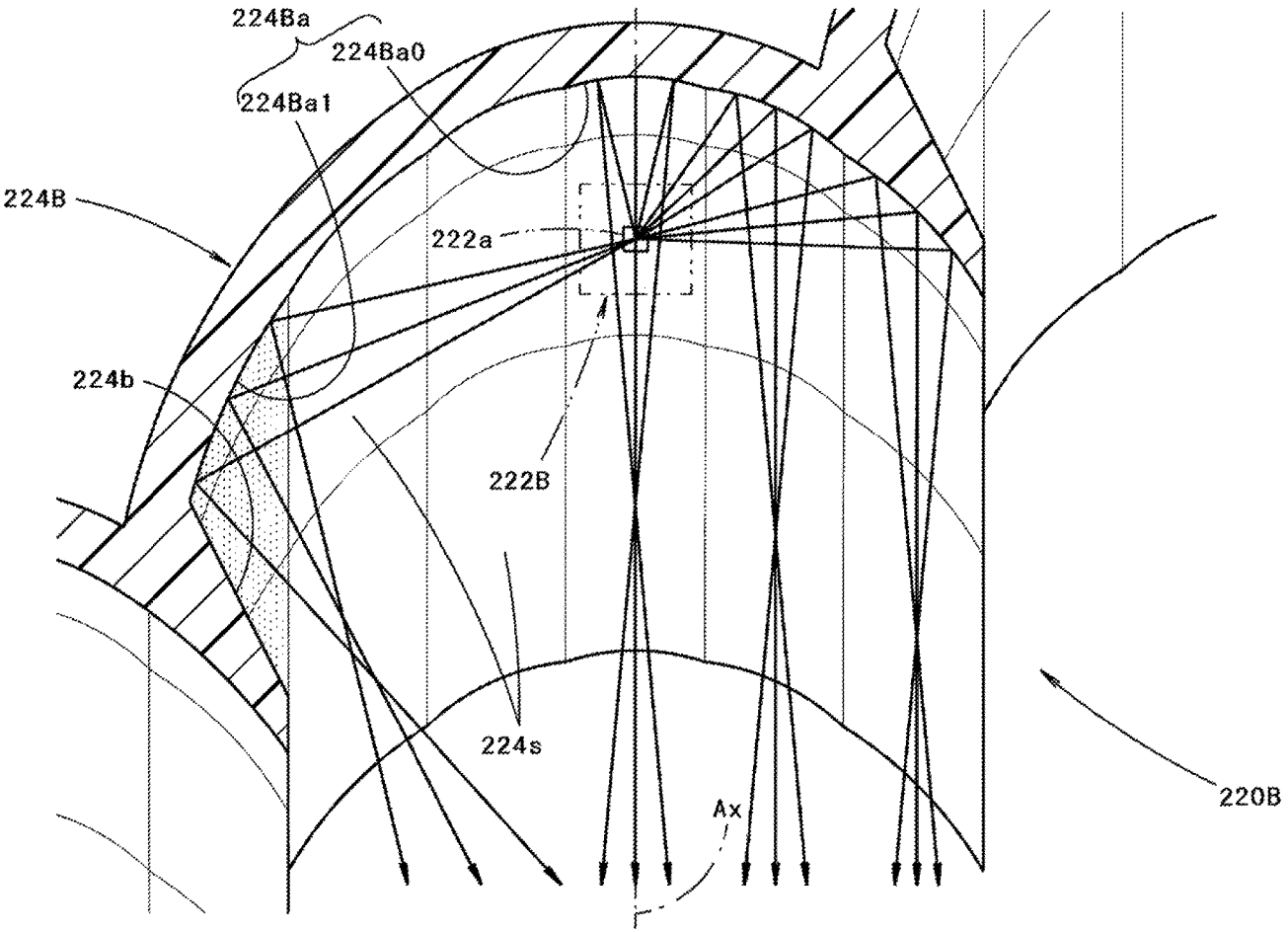
FIG. 11 is a detailed view of a part IV in FIG. 9.

FIG. 11 is a detailed view of a part IV in FIG. 9.

Hereinafter, a specific shape of the reflective surface of each reflector 224 is described with reference to FIG. 11.

The reflective surface 224Aa of the first reflector 224A has a bilaterally symmetrical shape in a vertical surface including the axis Ax. Further, the reflective surface 224Aa is configured by a plurality of reflective elements 224*s* arranged in a grid pattern. At that time, each of these reflective elements 224*s* is formed to have, as a reference surface, a paraboloid of revolution in which a light emitting center of the light source 222 is a focal point and the axis Ax extending in the longitudinal direction is a center axis.

By doing so, in the first reflector 224A, each of the reflective elements 224*s* of the reflective surface 224Aa is adapted to diffusely reflect the light from the first light source 222A in the vertical and lateral directions around the lamp front direction (i.e., X direction). At that time, each reflective element 224*s* is formed so as to reflect the light from the first light source 222A in a relatively small diffusion angle in the vertical direction and in a relatively large diffusion angle in the lateral direction.

A reflective surface 224Ba of the second reflector 224B (i.e., the reflector 224 close to the outside in the vehicle width direction of the first reflector 224A) is configured by a reflective surface main body portion 224Ba0 having the same shape as the reflective surface 224Aa of the first reflector 224A, and a first overlapping portion 224Ba1 overlapping with the reflective surface 224Aa of the first reflector 224A, as seen from the front of the lamp.

For the vertical sectional shape, the first overlapping portion 224Ba1 is similar to the case of the reflective surface main body portion 224Ba0. However, for the horizontal sectional shape, the first overlapping portion 224Ba1 is formed as a curve close to an ellipse whose curvature is slightly greater than that of an extension line of a parabola to form a horizontal sectional shape of the reference surface of the reflective surface main body portion 224Ba0.

In this way, the first overlapping portion 224Ba1 is adapted to reflect the light from the second light source 222B in a direction inclined to the outside in the vehicle width direction toward the front of the lamp and to irradiate the reflected light as light that is largely diffused in a horizontal direction.

The third reflector 224C (i.e., the reflector 224 close to the outside in the vehicle width direction of the second reflector 224B) also includes a reflective surface 224Ca that is completely similar to that of the second reflector 224B. Namely, the reflective surface 224Ca of the third reflector 224C is also configured by a reflective surface main body portion 224Ca0 and a second overlapping portion 224Ca1 similar to the first overlapping portion 224Ba1.

Further, the reflective surfaces 224*a* of the fourth and fifth reflectors 224 from the inside in the vehicle width direction are also configured by a reflective surface main body portion 224*a*0 similar to the reflective surface main body portion 224Ba0 of the second reflector 224B, and an overlapping portion 224*a*1 similar to the first overlapping portion 224Ba1 of the second reflector 224B.

Out of five reflectors 224, the reflectors 224 other than the first reflector 224A located at the outermost in the vehicle width direction have a rear wall 224*b* that is a portion located in front of the overlapping portion 224*a*1 (including the first and second overlapping portions 224Ba1, 24Ca1) of the reflector 224, which is close to the outside in the vehicle width direction of each reflector. The rear wall 224*b* has a horizontal sectional shape which linearly extends in a direction inclined to the outside in the vehicle width direction toward the front of the lamp.

At that time, an inclined angle of the rear wall 224*b* to the outside in the vehicle width direction is set to a value smaller than an inclined angle of a left end edge portion of a reflective surface main body portion 224*a*0 of each reflector 224 to the outside in the vehicle width direction. In this way, a mold removal direction when molding five reflectors 224 formed as a single member can be set in a direction inclined to the outside in the vehicle width direction toward the front of the lamp.

Figure 12:
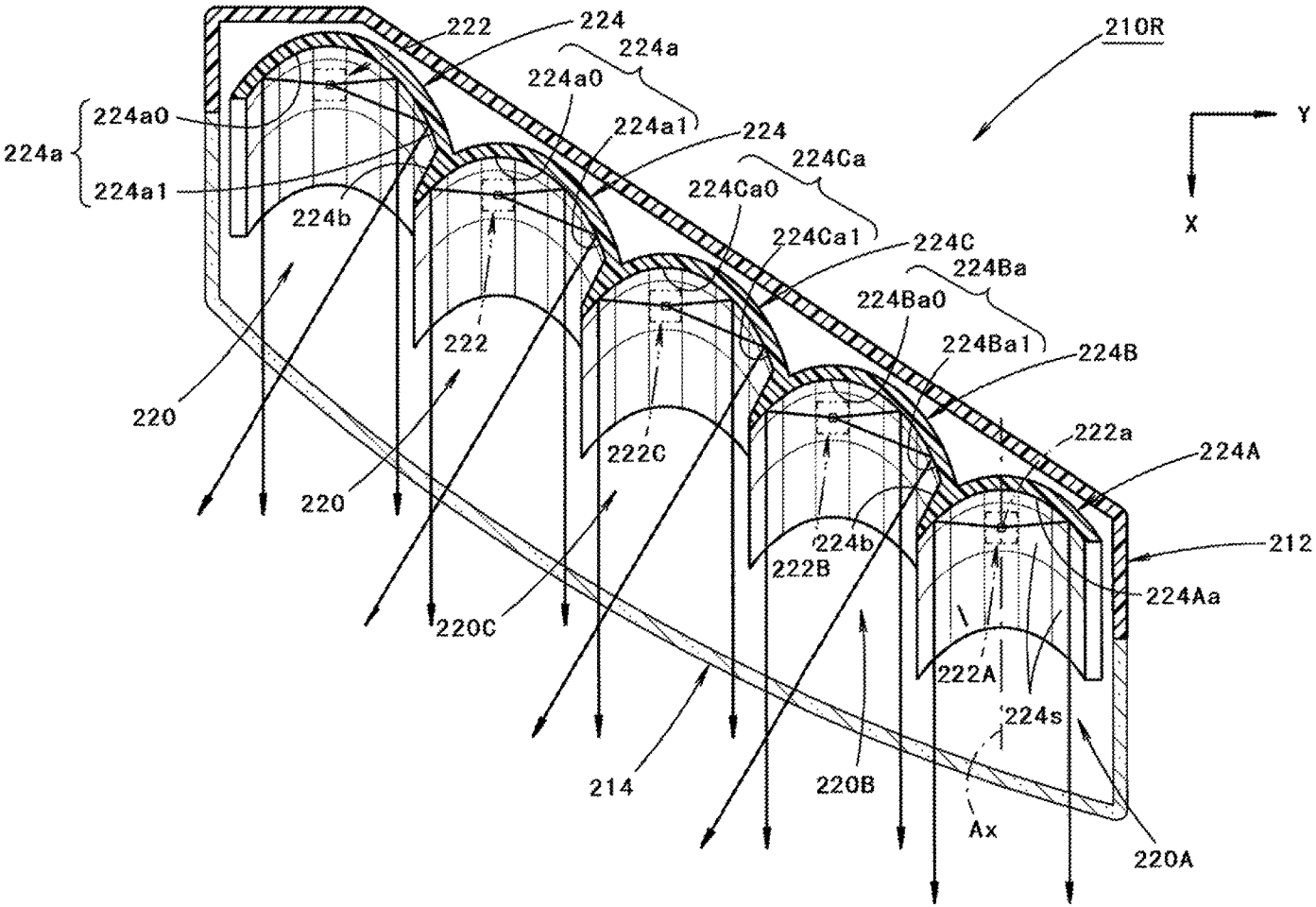
FIG. 12 is a view similar to FIG. 9, showing a right vehicle lamp according to the second embodiment.

FIG. 12 is a view similar to FIG. 9, showing a right vehicle lamp 210R according to the present embodiment.

The right vehicle lamp 210R is a lamp used in pair with the vehicle lamp 210L and is a high-beam headlamp provided in a right front end portion of the vehicle.

The right vehicle lamp 210R has a shape bilaterally-symmetrical with the vehicle lamp 210L and is disposed in a positional relationship bilaterally-symmetrical with the vehicle lamp 210L.

Figure 13A:
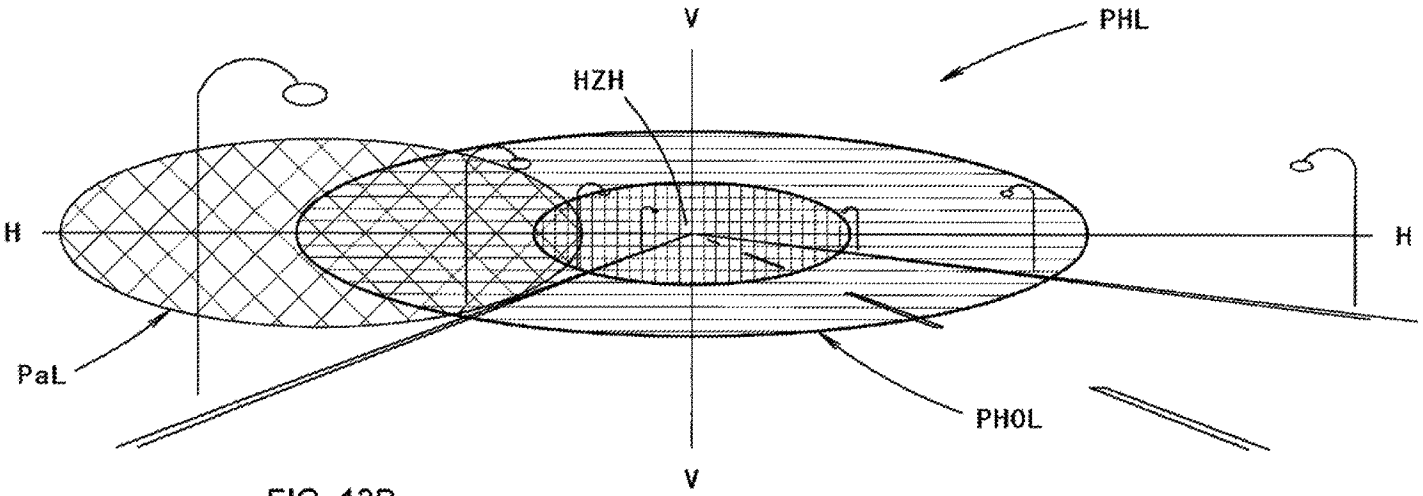
FIG. 13A is a view perspectively showing a high-beam light distribution pattern that is formed on a virtual vertical screen disposed at a position of 25 m in front of the vehicle lamp by the light irradiated forward from the left vehicle lamp.

FIG. 13A is a view perspectively showing a high-beam light distribution pattern PHL that is formed on a virtual vertical screen disposed at a position of 25 m in front of the vehicle lamp by the light irradiated forward from the left vehicle lamp 210L.

The high-beam light distribution pattern PHL is formed as a combined light distribution pattern of a basic light distribution pattern PH0L and an additional light distribution pattern PaL.

The basic light distribution pattern PH0L is a light distribution pattern that is formed by the reflected light from the reflective surface 224Aa of the first reflector 224A and the reflected light from the reflective surface main body portion 224*a*0 (including the reflective surface main body portions 224Ba0, 224Ca0) in the reflective surface 224*a* of remaining four reflectors 224.

The basic light distribution pattern PH0L is formed as a light distribution pattern significantly spreading to both left and right sides about H-V that is a vanishing point in the lamp front direction. Further, a high luminous intensity area HZH is formed about the H-V.

On the other hand, the additional light distribution pattern PaL is a light distribution pattern that is formed by the reflected light from the overlapping portion 224*a*1 (including the first and second overlapping portions 224Ba1, 224Ca1) in the reflective surface 224*a* of four reflectors 224 other than the first reflector 224A.

The additional light distribution pattern PaL is formed as a light distribution pattern significantly spreading in the horizontal direction on the left of the basic light distribution pattern PH0L and a right end portion thereof is partially overlapped with the basic light distribution pattern PH0L.

Figure 13B:
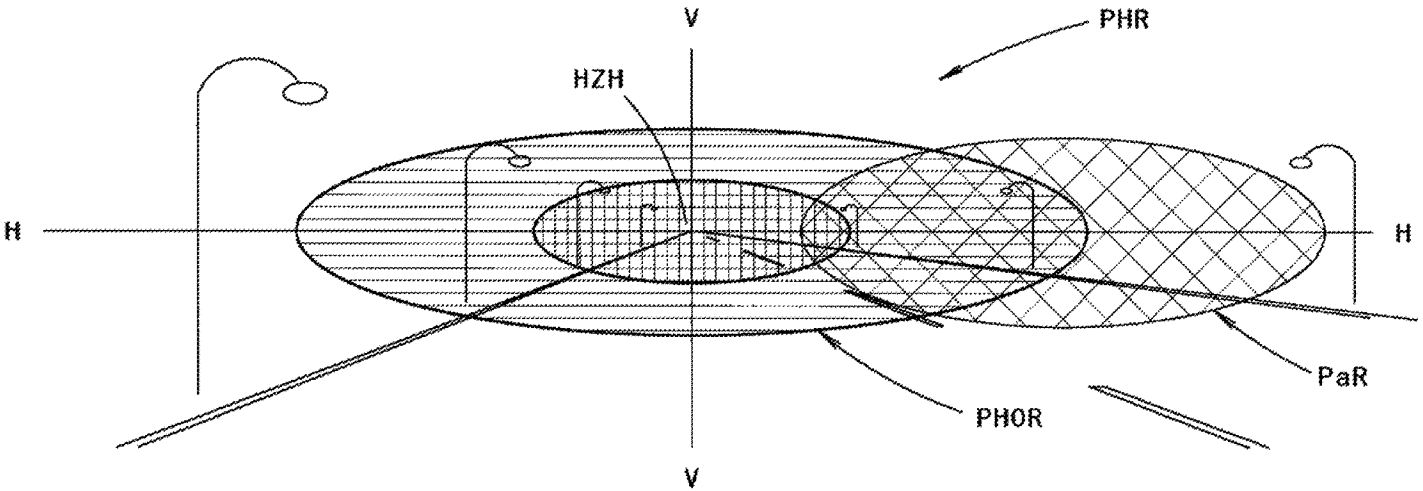
FIG. 13B is a view perspectively showing a high-beam light distribution pattern that is formed on the virtual vertical screen by the light irradiated forward from the right vehicle lamp.

FIG. 13B is a view perspectively showing a high-beam light distribution pattern PHR that is formed on the virtual vertical screen by the light irradiated forward from the vehicle lamp 210R.

The high-beam light distribution pattern PHR is formed as a combined light distribution pattern of a basic light distribution pattern PH0R and an additional light distribution pattern PaR.

The basic light distribution pattern PH0R is a light distribution pattern corresponding to the basic light distribution pattern PH0L of the high-beam light distribution pattern PHL. The basic light distribution pattern PH0R is formed as a light distribution pattern similar to the basic light distribution pattern PH0L.

On the other hand, the additional light distribution pattern PaR is a light distribution pattern corresponding to the additional light distribution pattern PaL of the high-beam light distribution pattern PHL. The additional light distribution pattern PaR is formed in a positional relationship bilaterally-symmetrical with the additional light distribution pattern PaL.

As shown in FIG. 13A, in the high-beam light distribution pattern PHL, the basic light distribution pattern PH0L widely irradiates the front area of the vehicle front travelling lane and the additional light distribution pattern PaL widely irradiates the left area of the vehicle front travelling lane.

On the other hand, as shown in FIG. 13B, in the high-beam light distribution pattern PHR, the basic light distribution pattern PH0R widely irradiates the front area of the vehicle front travelling lane and the additional light distribution pattern PaR widely irradiates the right area of the vehicle front travelling lane.

Further, as the entire vehicle, a high-beam light distribution pattern is formed as a combined light distribution pattern of the high-beam light distribution pattern PHL shown in FIG. 13A and the high-beam light distribution pattern PHR shown in FIG. 13B by the irradiation light from a pair of left and right vehicle lamps 210L, 210R. In this way, the vehicle front travelling lane is widely irradiated from the left area to the right area.

Next, function effects of the present embodiment are described.

In each of the vehicle lamps 210L, 210R according to the present embodiment, the second reflector 224B of the second lamp unit 220B close to the outside in the vehicle width direction of the first lamp unit 220A is disposed on the rear side of the first reflector 224A of the first lamp unit 220A. Further, the reflective surface 224Ba is formed so as to extend to the inside in the vehicle width direction up to a position of partially overlapping with the reflective surface 224Aa of the first reflector 224A, as seen from the front of the lamp. Further, the first overlapping portion 224Ba1 is formed so as to reflect the light from the second light source 222B toward the outside in the vehicle width direction. As a result, the following function effects can be obtained.

Specifically, as the irradiation light from the second lamp unit 220B, the reflected light from the first overlapping portion 224Ba1 in the reflective surface 224Ba of the second reflector 224B can be additionally utilized. Therefore, it is possible to increase the irradiation light quantity of the entire lamp, correspondingly. By doing so, it is possible to secure a sufficient irradiation light quantity in a limited space of each of the vehicle lamps 210L, 210R. At that time, the outside area in the vehicle width direction in front of the lamp can be irradiated by the reflected light from the first overlapping portion 224Ba1.

In contrast to the present invention, the following configuration is also conceivable. Namely, the first overlapping portion 224Ba1 is not provided in the reflective surface 224Ba of the second reflector 224B. Instead of the first overlapping portion 224Ba1, a side wall extending from a right end position of the reflective surface main body portion 224Ba0 to a left end position of the reflective surface 224Aa of the first reflector 224A is formed, and the light from the second light source 222B is reflected by the side wall in a direction inclined to the outside in the vehicle width direction toward the front of the lamp.

However, in the case of having these configurations, the reflected light from the side wall is not controlled. Therefore, the reflected light is difficult to contribute to an increase in the irradiation light quantity.

By contrast, in the present embodiment, the first overlapping portion 224Ba1 is configured as a reflective area extending to the inside in the vehicle width direction from the reflective surface main body portion 224Ba0 in the reflective surface 224Ba of the second reflector 224B. Therefore, the controlled reflected light from the first overlapping portion 224Ba1 can contribute to an increase in the irradiation light quantity.

Thus, according to the present embodiment, for each of the vehicle lamps 210L, 210R where a plurality of lamp units 220 is arranged side by side in the vehicle width direction, it is possible to secure a sufficient irradiation light quantity in a limited space.

Each of the vehicle lamps 210L, 210R according to the present embodiment is respectively arranged at a left end portion in the vehicle width direction and a right end portion in the vehicle width direction, which are formed to be curved to the rear side of the vehicle. Therefore, it is possible to easily achieve a configuration that the second reflector 224B of the second lamp unit 220B is disposed on the rear side of the first reflector 224A of the first lamp unit 220A.

In the present embodiment, the third reflector 224C of the third lamp unit 220C close to the outside in the vehicle width direction of the second lamp unit 220B is disposed on the rear side of the second reflector 224B, the reflective surface 224Ca of the third reflector 224C is formed so as to extend to the inside in the vehicle width direction up to a position of partially overlapping with the reflective surface 224Ba of the second reflector 224B, as seen from the front of the lamp, and the second overlapping portion 224Ca1 of the reflective surface 224Ca is formed so as to reflect the light from the third light source 222C toward the outside in the vehicle width direction. As a result, the following function effects can be obtained.

Specifically, as the irradiation light from the third lamp unit 220C, the reflected light from the second overlapping portion 224Ca1 in the reflective surface 224Ca of the third reflector 224C can be additionally utilized. Therefore, it is possible to increase the irradiation light quantity of the entire lamp, correspondingly. By doing so, for each of the vehicle lamps 210L, 210R, it is possible to further easily secure a sufficient irradiation light quantity in a limited space.

Furthermore, in the present embodiment, the reflectors 224 of remaining two lamp units 220 have the same configuration. Accordingly, it is possible to further increase the irradiation light quantity of the entire lamp.

At that time, in the present embodiment, the basic light distribution pattern PH0L of the high-beam light distribution pattern PHL formed by the irradiation light from the left vehicle lamp 210L can widely irradiate the front area of the vehicle front travelling lane, and the additional light distribution pattern PaL thereof can widely irradiate the left area of the vehicle front travelling lane. Further, the basic light distribution pattern PH0R of the high-beam light distribution pattern PHR formed by the irradiation light from the right vehicle lamp 210R can widely irradiate the front area of the vehicle front travelling lane, and the additional light distribution pattern PaR thereof can widely irradiate the right area of the vehicle front travelling lane.

Therefore, as the entire vehicle, the vehicle front travelling lane can be widely irradiated from the left area to the right area by the irradiation light from a pair of left and right vehicle lamps 210L, 210R.

In the above embodiment, an example has been described in which the reflective surface main body portion 224*a*0 (including the reflective surface main body portions 224Ba0, 224Ca0) of the reflective surface 224Aa of the first reflector 224A and the reflective surfaces 224*a* of other reflectors 224 is configured by a plurality of reflective elements 224*s*. However, the reflective surface main body portion may be configured as a reflective surface made of a single curved surface.

In the above embodiment, an example has been described in which five reflectors 224 are formed as a single member by an integral molding. However, these reflectors may be formed as a separate member.

In the above embodiment, each lamp unit 220 has a configuration that the reflector 224 is disposed below the light source 222 arranged in a state where the light emitting surface 222*a* of the light source 222 faces downward. However, each lamp unit may have other configurations (e.g., a configuration that the reflector 224 is disposed above the light source 222 arranged in a state where the light emitting surface 222*a* faces upward).

In the above embodiment, an example has been described in which each of vehicle lamp 210L, 210R is configured as a headlamp for forming a high-beam light distribution pattern. However, the vehicle lamp may be configured as a headlamp for forming a low-beam light distribution pattern. Furthermore, the vehicle lamp may be configured as a fog lamp or a daytime running lamp, or may be configured as a marker lamp such as a tail lamp, for example.

Modified Example of Second Embodiment

Subsequently, a modified example of the second embodiment is described.

Figure 14:
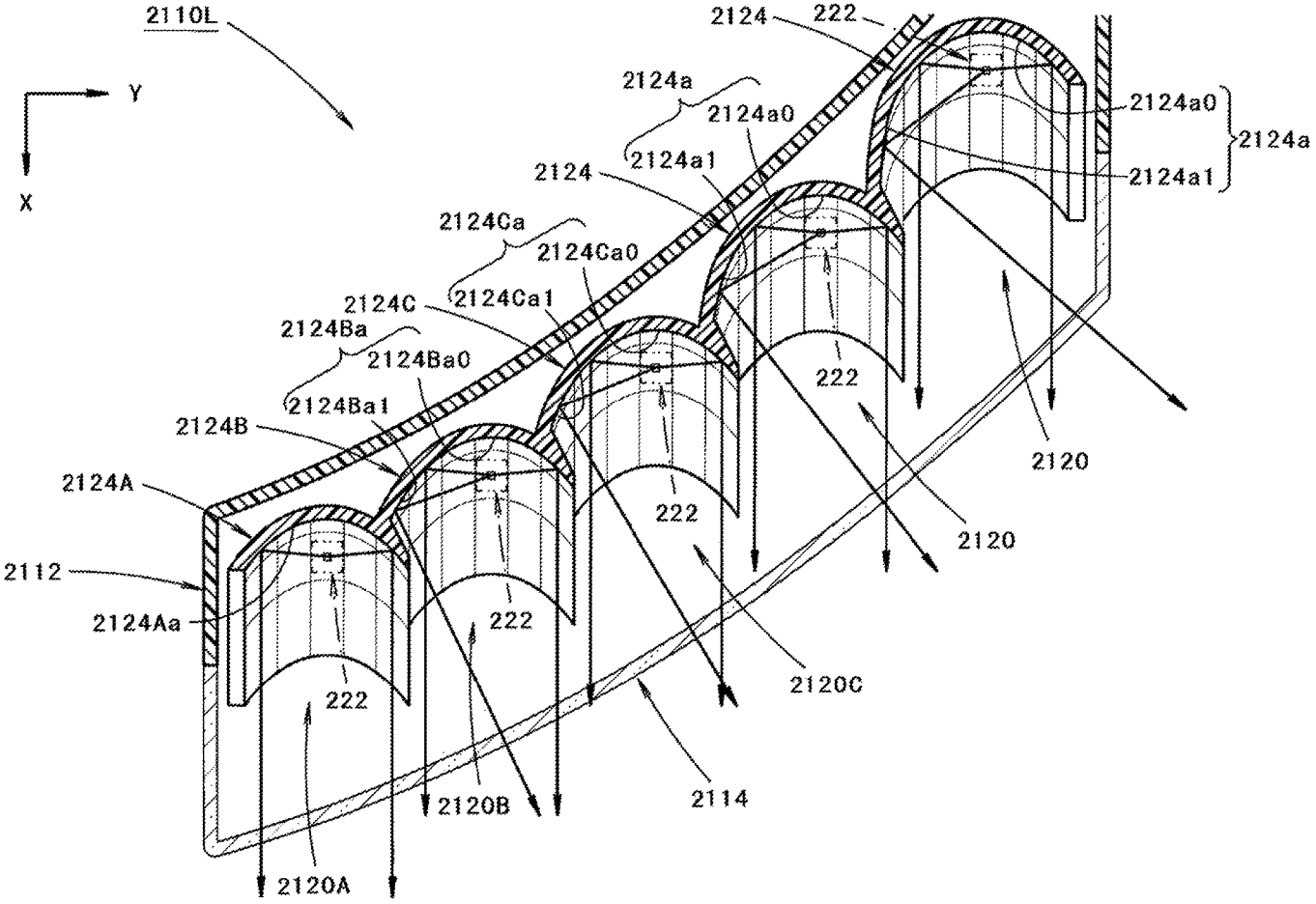
FIG. 14 is a view similar to FIG. 9, showing a left vehicle lamp according to a modified example of the second embodiment.

FIG. 14 is a view similar to FIG. 9, showing a left vehicle lamp 2110L according to the present modified example.

As shown in FIG. 14, a basic configuration of this vehicle lamp 2110L is similar to the vehicle lamp 210L of the above embodiment. However, a configuration of a reflector 2124 other than a first reflector 2124A of a first lamp unit 2120A is different from the case of the above embodiment.

Specifically, also in the present modified example, five lamp units 2120 are arranged side by side in the vehicle width direction, and, at that time, one located at the outside in the vehicle width direction is arranged in a state of being further displaced rearward. Further, reflective surfaces 2124*a* of the reflectors 2124 other than the first reflector 2124A are formed so as to extend to the inside in the vehicle width direction up to a position of partially overlapping with the reflective surface 2124*a* of the reflector 2124 close to the inside in the vehicle width direction of each reflector. Furthermore, reflective surface main body portions 2124Ba0, 2124Ca0 in reflective surfaces 2124Ba, 2124Ca of second and third reflectors 2124B, 2124C have the same shape as a reflective surface 2124Aa of the first reflector 2124A. This is similarly applied to reflective surface main body portions 2124*a*0 of the reflective surfaces 2124*a* of remaining two reflectors 2124.

However, in the present modified example, the rearward displacement amount among respective lamp units 2120 is set to a larger value as it is located at the outside in the vehicle width direction.

Along with this, the rearward displacement amount among respective light sources 222 is also set to a larger value as it is located at the outside in the vehicle width direction.

Further, along with this, the rearward displacement amount of the third reflector 2124C of the third lamp unit 2120C with respect to the second reflector 2124B of the second lamp unit 2120B is set to a value greater than the rearward displacement amount of the second reflector 2124B with respect to the first reflector 2124A. Further, in the fourth lamp unit 2120 from the inside in the vehicle width direction, the rearward displacement amount of the reflector 2124 with respect to the third reflector 2124C is set to a value greater than the rearward displacement amount of the third reflector 2124C with respect to the second reflector 2124B. Furthermore, the same relationship is maintained between the reflector 2124 in the fourth lamp unit 2120 from the inside in the vehicle width direction and the reflector 2124 in the fifth lamp unit 2120 from the inside in the vehicle width direction.

Further, in the present modified example, a deflection angle to the outside in the vehicle width direction of the reflected light from the second overlapping portion 2124Ca1 in the reflective surface 2124Ca of the third reflector 2124C is set to a value greater than a deflection angle to the outside in the vehicle width direction of the reflected light from the first overlapping portion 2124Ba1 in the reflective surface 2124Ba of the second reflector 2124B.

Further, a deflection angle to the outside in the vehicle width direction of the reflected light from the overlapping portion 2124*a*1 in the reflective surface 2124*a* of the fourth reflector 2124 is set to a value greater than a deflection angle to the outside in the vehicle width direction of the reflected light from the second overlapping portion 2124Ca1.

Furthermore, a deflection angle to the outside in the vehicle width direction of the reflected light from the overlapping portion 2124*a*1 in the reflective surface 2124*a* of the fifth reflector 2124 is set to a value greater than the case of the fourth reflector 2124.

In the preset modified example, a rearwardly curved amount of a translucent cover 2114 is large, as compared to the case of the above embodiment, and the lamp body 2112 has a shape corresponding thereto.

Also in the present modified example, a right vehicle lamp (not shown) has a bilaterally symmetrical configuration with respect to the left vehicle lamp 2110L.

Also in the case of employing the configuration of the present modified example, the same function effects as the above embodiment can be obtained.

Moreover, in the present modified example, the rearward displacement amount of the third reflector 2124C with respect to the second reflector 2124B is set to a value greater than the rearward displacement amount of the second reflector 2124B with respect to the first reflector 2124A. Therefore, these can be arranged without difficulty, despite the fact that the rearwardly curved amount of the translucent cover 2114 is large. Furthermore, at that time, a deflection angle to the outside in the vehicle width direction of the reflected light from the second overlapping portion 2124Ca1 in the reflective surface 2124Ca of the third reflector 2124C having a large rearward displacement amount is set to a value greater than a deflection angle to the outside in the vehicle width direction of the reflected light from the first overlapping portion 2124Ba1 in the reflective surface 2124Ba of the second reflector 2124B having a small rearward displacement amount. Therefore, the deflection angle to the outside in the vehicle width direction of the reflected light can be easily set to different values between the first overlapping portion 2124Ba1 and the second overlapping portion 2124Ca1.

Further, since, in this way, the deflection angle to the outside in the vehicle width direction of the reflected light from the first overlapping portion 2124Ba1 and the deflection angle to the outside in the vehicle width direction of the reflected light from the second overlapping portion 2124Ca1 are set to different values, it is possible to uniformly irradiate over a wide range of the outside area in the vehicle width direction in front of the lamp.

Furthermore, in the present modified example, the similar relationship is maintained between the overlapping portion 2124*a*1 and the second overlapping portion 2124Ca1 in the reflective surface 2124*a* of the fourth reflector 2124, and between the overlapping portion 2124*a*1 in the reflective surface 2124*a* of the fourth reflector 2124 and the overlapping portion 2124*a*1 in the reflective surface 2124*a* of the fifth reflector 2124. Therefore, the deflection angle to the outside in the vehicle width direction of the reflected light can be easily set to different values among respective overlapping portions 2124*a*1 (including the first and second overlapping portions 2124Ba1, 2124Ca1) even in the case where the translucent cover 2114 having a large rearwardly curved amount is formed to extend long in the curved direction, as in the vehicle lamp 2110L according to the present modified example.

Numerical values shown as specifications in the above embodiments and the modified examples thereof are merely examples. Naturally, these numerical values may be appropriately set to other values.

Further, the present invention is not limited to the configurations described in the above embodiments and the modified examples thereof, but can employ other configurations to which various modifications are made.

Although the present invention has been described in detail with reference to specific embodiments, it is apparent to those skilled in the art that various modifications or changes can be made without departing from the spirit and scope of the present invention.

This application is based upon Japanese Patent Application (Patent Application No. 2013-110915) filed on May 27, 2013 and Japanese Patent Application (Patent Application No. 2013-113082) filed on May 29, 2013, the contents of which are incorporated herein by reference.

REFERENCE NUMERALS LIST

10, 110 Vehicle Lamp
12, 112 Lamp Body
14 Translucent Cover
20A First Lamp Unit
20B Second Lamp Unit
20C, 120C Third Lamp Unit
22A First Light Emitting Element
22B Second Light Emitting Element
22C, 122C Third Light Emitting Element
22*a*, 122*a* Light Emitting Surface
24A First Reflector
24A1, 24B1, 24C1, 34A1, 34B1, 124C1 Front End Edge
24Aa, 24Ba, 24Ca, 34Aa, 34Ba, 124Ca Reflective Surface
24As, 24Bs, 24Cs, 34As, 34Bs, 124Cs Reflective Element
24B Second Reflector
24C, 124C Third Reflector
26, 126A, 126B, 126C Substrate
34A First Additional Reflector
34B Second Additional Reflector
Ax1, Ax2, Ax3 Axis
HZ High Luminous Intensity Area
PA0, PB0, PC Basic Light Distribution Pattern
PAa, PBa Additional Light Distribution Pattern
PC1 Light Distribution Pattern
PH High-Beam Light Distribution Pattern
210L, 210R, 2110L Vehicle Lamp
212, 2112 Lamp Body
214, 2114 Translucent Cover
220, 2120 Lamp Unit
220A, 2120A First Lamp Unit
220B, 2120B Second Lamp Unit
220C, 2120C Third Lamp Unit
222 Light Source
222A First Light Source
222B Second Light Source
222C Third Light Source
222*a* Light Emitting Surface
224, 2124 Reflector
224A, 2124A First Reflector
224Aa, 224Ba, 224Ca, 224*a*, 2124Aa, 2124Ba, 2124Ca, 2124*a* Reflective Surface
224B, 2124B Second Reflector

224Ba0, 224Ca0, 224*a*0, 2124Ba0, 2124Ca0, 2124*a*0 Reflective Surface Main Body Portion
224Ba1, 2124Ba1 First Overlapping Portion
224C, 2124C Third Reflector
224Ca1, 2124Ca1 Second Overlapping Portion
224*a*1, 2124*a*1 Overlapping Portion
224*b* Rear Wall
224*s* Reflective Element
226 Substrate
Ax Axis
HZH High Luminous Intensity Area
PHL, PHR High-Beam Light Distribution Pattern
PH0L, PH0R Basic Light Distribution Pattern
PaL, PaR Additional Light Distribution Pattern

What is claimed is:

1. A vehicle lamp comprising:

a first lamp unit comprising a first light emitting element and a first reflector configured to reflect the light from the first light emitting element toward the front, and a second lamp unit comprising a second light emitting element and a second reflector configured to reflect the light from the second light emitting element toward the front, wherein the first lamp unit and the second lamp unit are arranged side by side in a direction intersecting with a lamp longitudinal direction, and a first additional reflector configured to reflect the light from the second light emitting element toward the front is provided only on a lower portion of the first lamp unit.

2. The vehicle lamp according to claim 1, wherein a second additional reflector configured to reflect the light from the first light emitting element toward the front is provided only on a lower portion of the second lamp unit.

3. The vehicle lamp according to claim 2, wherein each of the first and second light emitting elements is a light emitting element that has a light emitting surface extending in the direction intersecting with the lamp longitudinal direction.

4. The vehicle lamp according to claim 1, wherein a third lamp unit is disposed between the first lamp unit and the second lamp unit.

5. The vehicle lamp according to claim 4, wherein the third lamp unit comprises a third light emitting element and a third reflector configured to reflect the light from the third light emitting element toward the front.

6. The vehicle lamp according to claim 1, wherein the first lamp unit and the second lamp unit contact each other in the direction intersecting with the lamp longitudinal direction.

7. The vehicle lamp according to claim 1, wherein the first lamp unit and the second lamp unit overlap with each other in the direction intersecting with the lamp longitudinal direction.

8. The vehicle lamp according to claim 1, wherein the first additional reflector is configured to reflect the light from the second light emitting element directly toward the front of the vehicle lamp.

* * * * *